US006059631A

United States Patent [19]

Maddock

[11] Patent Number: 6,059,631

[45] Date of Patent: May 9, 2000

[54] TOY CONSTRUCTION KIT WITH INTERCONNECTING BUILDING PIECES

[76] Inventor: Paul Thomas Maddock, c/o Vecta Blocks Inc 1515 Pitfield St Laurent, Quebec, Canada, H4S 1G3

[21] Appl. No.: 09/149,477

[22] Filed: Sep. 8, 1998

Related U.S. Application Data

[63] Continuation-in-part of application No. PCT/CA97/00138, Feb. 28, 1997.

[51] Int. Cl.[7] ..... A63H 33/08; A63H 33/12

[52] U.S. Cl. ..... 446/127; 446/104; 446/126; 52/DIG. 10

[58] Field of Search ..... 446/85, 86, 105, 446/106, 109, 111, 112, 115, 116, 118, 120, 121, 122, 124, 126, 127, 128; 52/DIG. 10

[56] References Cited

U.S. PATENT DOCUMENTS

| | | | |
|---|---|---|---|
| 1,281,856 | 10/1918 | Shaw . | |
| 1,294,446 | 2/1919 | Greenstreet | 446/127 X |
| 1,883,214 | 10/1932 | Wilson et al. . | |
| 1,898,297 | 2/1933 | Fox . | |
| 2,028,229 | 1/1936 | Luhn . | |
| 2,472,363 | 6/1949 | Blackington . | |
| 2,619,829 | 12/1952 | Tatum . | |
| 2,633,662 | 4/1953 | Nelson . | |
| 2,907,137 | 10/1959 | Ehrmann . | |
| 3,032,919 | 5/1962 | Amsler . | |
| 3,456,413 | 7/1969 | Fischer . | |
| 3,558,138 | 1/1971 | Lemelson . | |
| 3,624,954 | 12/1971 | Van DerVeken . | |
| 3,626,632 | 12/1971 | Bullock, Jr. . | |
| 3,657,838 | 4/1972 | Hanning et al. . | |
| 3,670,449 | 6/1972 | Lemkin et al. . | |
| 3,791,090 | 2/1974 | Kniefel . | |
| 3,811,219 | 5/1974 | Fischer . | |
| 3,827,177 | 8/1974 | Wengel . | |
| 3,987,579 | 10/1976 | Palenik, III | 446/124 X |
| 4,007,555 | 2/1977 | Sasaoka . | |
| 4,035,977 | 7/1977 | Fischer . | |
| 4,050,184 | 9/1977 | Chiari | 446/124 X |
| 4,109,409 | 8/1978 | Fischer . | |
| 4,171,591 | 10/1979 | Fischer . | |
| 4,202,131 | 5/1980 | Poleri . | |
| 4,214,403 | 7/1980 | Knudsen . | |
| 4,309,852 | 1/1982 | Stolpin | 446/116 X |
| 4,355,781 | 10/1982 | Stolpin | 249/64 |

(List continued on next page.)

FOREIGN PATENT DOCUMENTS

| | | | |
|---|---|---|---|
| 208999 | 11/1966 | Switzerland | 446/127 |
| 941847 | 11/1963 | United Kingdom . | |
| 2232382 | 12/1990 | United Kingdom | 446/127 |
| WO 94/20186 | 9/1994 | WIPO | 446/124 |

*Primary Examiner*—D. Neal Muir
*Attorney, Agent, or Firm*—Birch, Stewart, Kolasch & Birch, LLP

[57] ABSTRACT

Toy building pieces are disclosed which may be advantageously used in conjunction with a variety of different shaped framing pieces or connectors for building of structures such as polyhedral figures, geodesic domes or many other structures. One or more faces of the building pieces have interlocking devices and have an aperture in the surface thereof to receive a thin rectangular shape such as a craft stick, or a circular shaped end of a framing piece of various cross-section or connectors which are I-shaped in cross-section. Other faces of the piece may incorporate piece interconnection devices, which may include for example: especially configured angular connection pieces which can be used in conjunction with other pieces to construct polyhedral figures, other pieces designed for hinged connection; a dovetail tongue on one part adapted to engage a dovetail groove on another part; or a tongue projecting from a face to engage one of the apertures. Other interconnecting devices are also contemplated. In effect, adapter pieces are provided to change the connection devices of a piece. In a kit or collection of such building pieces, a combination of various configurations of such pieces is provided.

69 Claims, 13 Drawing Sheets

U.S. PATENT DOCUMENTS

| | | | |
|---|---|---|---|
| 4,423,465 | 12/1983 | Ten-Ching et al. . | |
| 4,673,057 | 6/1987 | Glassco | 52/DIG. 10 X |
| 4,701,131 | 10/1987 | Hildebrandt et al. | 446/126 X |
| 4,703,594 | 11/1987 | Reber | 52/DIG. 10 X |
| 4,744,780 | 5/1988 | Volpe . | |
| 4,758,196 | 7/1988 | Wang . | |
| 4,764,143 | 8/1988 | Gat et al. . | |
| 4,833,856 | 5/1989 | Zwagerman . | |
| 5,100,359 | 3/1992 | Gorio . | |
| 5,137,486 | 8/1992 | Glickman . | |
| 5,199,919 | 4/1993 | Glickman . | |
| 5,350,331 | 9/1994 | Glickman . | |
| 5,527,201 | 6/1996 | Maddock . | |
| 5,575,701 | 11/1996 | Hantman . | |
| 5,707,268 | 1/1998 | Outman . | |
| 5,775,046 | 7/1998 | Fanger et al. . | |

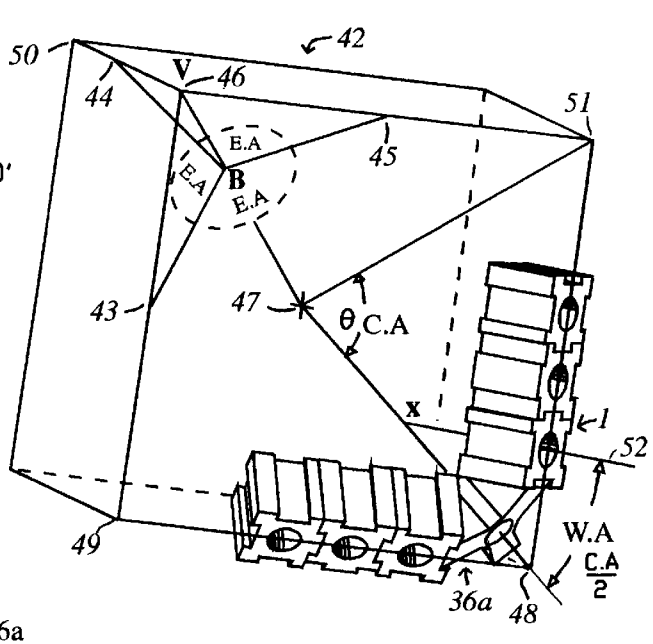
FIG.21
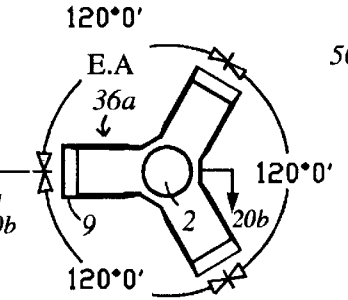
FIG.20a
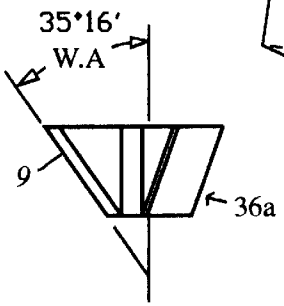
FIG.20b
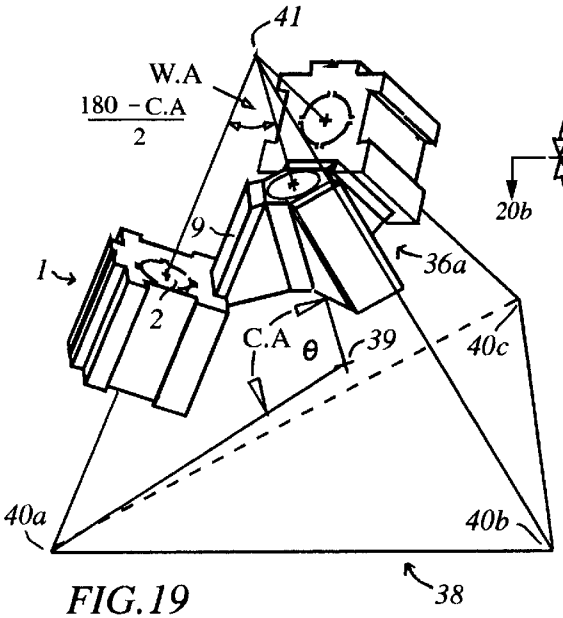
FIG.19
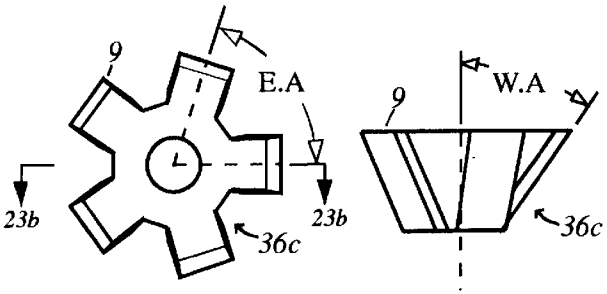
FIG.23b
FIG.23a
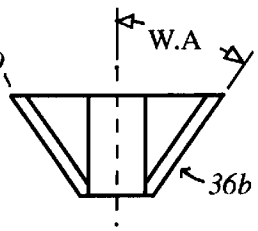
FIG.22b
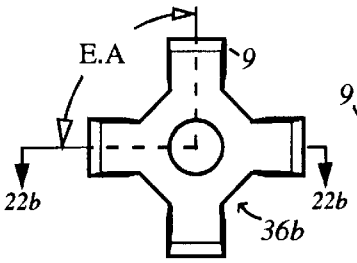
FIG.22a

TOY CONSTRUCTION KIT WITH INTERCONNECTING BUILDING PIECES

RELATED INVENTIONS

This application is a continuation in part of PCT/CA97/00138 filed Feb. 28, 1997, the entire contents of which are hereby incorporated by reference.

BACKGROUND OF THE INVENTION (a) Field of the Invention

This invention relates to toy building blocks and in particular to interconnecting blocks which provide multiple connection means which are particularly suitable for constructing polyhedron or other geometric shapes.

(b) Description of the Prior Art

Toy building blocks of many different configurations are of course very well known and popular and have always been one of the most popular toys in a wide variety of cultures. The building blocks take many different forms and some of these forms have become extremely well known in association with their respective trademarks. The blocks employ various interconnection means to permit them to be snapped, or otherwise held, together in a fixed relationship in order to build structures.

Building toys also exist which employ hinged connections between the parts and a number of building toys employ connector pieces which permit structures to be assembled from larger framing pieces.

It is believed that the most pertinent such toy building blocks are disclosed in U.S. Pat. No. 5,527,201, patented Jun. 18, 1996, by the present inventor, Paul T. Maddock. That patent provided a toy construction kit with interconnecting holding means, and included a plurality of building pieces of various configurations, including building pieces each having six faces, each one of the six faces having interconnection means which was configured for direct connection to complementary interconnection means on other building pieces. The interconnection means in at least one of the faces included an aperture defined therein which was particularly sized and shaped to receive a connector member in the kit which was either a planar, essentially rectangular cross-section elongate element or a planar, essentially rectangular cross-section tongue integral with and extending from another building piece. The other faces each had other interconnection means, including at least two of the following: A pin which was parallel to a face of the piece which was particularly sized to engage a corresponding sleeve on another piece, for hinged connection such that one piece may rotate with respect to another piece; or a sleeve parallel to a face of the piece, which was particularly sized to engage a corresponding pin on another piece, for hinged connection such that one piece may rotate with respect to another piece; or a male dovetail on a face of the piece which was particularly sized to engage a corresponding female dovetail on another piece such that one piece slidably engages with another piece; or a female dovetail on a face of the piece, which was particularly sized to engage a corresponding male dovetail on another piece such that one piece slidably engaged with another piece; or a tongue of rectangular cross-section projecting from a face of the piece which was particularly sized to engage one of the apertures.

Among the prior toy block systems which may be relevant to the toy blocks of this invention are the following:

U.S. Pat. No. 3,657,838, patented Apr. 25, 1972 by R. Hanning et al. Some of the toy blocks taught by that patentee included corner pieces in the form of hollow rectangle parallelepiped blocks which had parallel-disposed, dovetail-shaped grooves, while other such toy blocks had parallel-disposed, dovetail-shaped ribs, while still others had both parallel disposed dovetail-shaped grooves and parallel disposed dovetail-shaped ribs. In addition, construction rods were provided which had dovetail-shaped projections at each end. Connection members were also provided which had such a cross-section that they were at least partly insertable into hollow spaces of the corner pieces. The construction rods were lockable by means of holding members.

U.S. Pat. No. 4,423,465, patented Dec. 27, 1983, by W. Teng-Ching et al. That patent taught cubic blocks which were used to assemble an electronic circuit. The structure of these blocks included a pair of dovetail-shaped recesses in one pair of its outer opposite surfaces and a pair of dovetail-shaped projections on another pair of its outer opposite surfaces, to provide four block-engaging surfaces or four joints. A plurality of blocks could thereby be put together by bringing a recess into union with a projection.

U.S. Pat. No. 5,775,046 patented Jul. 7, 1998 by D. J. Fanger et al. That patent provided modular construction units as L-shaped or U-shaped or open-ended rectangular parallelepiped boxes. Each of the members was provided with an array of cooperating dovetails and dovetail-shaped keyways. These elements were closely spaced so that a pair of such members can be meshed together and be locked against motion in two directions. Specially located engaging elements along the length of the construction units or the sides of the units made therefrom allowed mated construction members to be translated relative to each other as desired, even if one construction member was mated therewith, and bridged across two facing construction members, thus exhibiting translational symmetry. They also facilitate the rotation in place of any units made from a plurality of construction members, thus exhibiting rotational symmetry.

There is also a series of patents by Fischer Tecknik, namely: U.S. Pat. No. 3,456,413, patented Jul. 22, 1969 by A. Fischer; U.S. Pat. No. 3,811,219, patented May 21, 1974 by A. Fischer; U.S. Pat. No. 4,035,977, patented Jul. 19, 1977 by A. Fischer; U.S. Pat. No. 4,109,409, patented Aug. 29, 1978 by A. Fischer; and U.S. Pat. No. 4,171,591, patented Oct. 23, 1979 by A. Fischer; which all teach interlocking toy building blocks which include cooperation between dovetail ribs and dovetail grooves, with or without the use of locking members of rectangular or cylindrical shape.

In addition, there is a series of patents by Connector Set Toy Company and/or Connector Set Limited Partnership, namely: U.S. Pat. No. 5,137,486, patented Aug. 11, 1992, by J. L. Glickman; U.S. Pat. No. 5,199,919, patented Apr. 11, 1993, by J. L. Glickman; and U.S. Pat. No. 5,350,331, patented Sep. 27, 1994, by J. L. Glicknan; which all teach toy construction systems which interlock by means of struts which have flanged ends and a socket in the toy construction block.

Furthermore, there are also a number of patents, namely: U.S. Pat. No. 1,898,297, patented Feb. 21, 1933, by N. B. Fox; U.S. Pat. No. 2,472,363, patented Jun. 7, 1949, by J. G. Blackington; U.S. Pat. No. 2,619,829, patented Dec. 2, 1952, by B. L. Tatum; U.S. Pat. No. 2,907,137, patented Oct. 6, 1959, by R. R. M. Ehrmann; U.S. Pat. No. 3,558,138, patented Jan. 26, 1971, by J. H. Lemelson; U.S. Patent No. 3,791,090, patented Feb. 12, 1974, by A. B. Kniefel; U.S.

Pat. No. 4,007,555, patented Feb. 15, 1977, by N. Sasaoka; U.S. Pat. No. 4,202,131, patented May 13, 1949, by V. J. Poler; and U.S. Pat. No. 4,764,143, patented Aug. 16, 1988, by A. Gat et al; which all disclose various interlocking toy blocks whose interlocking is primarily by means of dovetail grooves and dovetail ribs.

There are also a number of patents, namely: U.S. Pat. No. 1,281,856, patented Oct. 15, 1918, by G. E. Shaw; U.S. Pat. No. 1,883,214, patented Oct. 18, 1918, by E. B. Wilson et al; U.S. Pat. No. 2,633,662, patented Apr. 7, 1953, by W. 0. Nelson; and U.S. Pat. No. 3,827,177, patented Aug. 6, 1974, by G. Wengel; which all teach toy construction sets in which the elements thereof are held together by cooperation between planar members and grooves in cube-like, cylindrical or disc-like connectors.

There are also two patents, namely: U.S. Pat. No. 2,028,229, patented Jan. 21, 1936, by H. P. Luhn; and U.S. Pat. No. 4,833,856, patented May 30, 1989, by J Zwagerman; which teach toy construction sets in which the individual elements are connected by "H"-cross-section connectors.

There are also a number of patents, namely: U.S. Pat. No. 3,624,954, patented Dec. 7, 1971, by G. Van Der Veken; U.S. Pat. No. 3,670,449, patented Jun. 20, 1972, by J. L. Lemnkin et al; U.S. Pat. No. 4,744,780, patented May 17, 1988, by L. S. Volpe; U.S. Pat. No. 4,758,196, patented Jul. 19, 1988, by T- H. Wang; U.S. Pat. No. 5,575,701, patented Nov. 19, 1996, by P. Hantman; U.S. Pat. No. 5,707,268, patented Jan. 13, 1998, by K. S. Outman; and British Patent No. 941,847, patented Nov. 13, 1963, by G. Stock; which all provide toy construction sets in which the individual units are held together through means cooperating with holes in the toy blocks.

There are also two patents, namely: U.S. Pat. No. 3,626,632, patented Dec. 14, 1971, by R. E. Bullock, Jr.; and U.S. Pat. No. 5,100,359, patented May 31, 1992, by F. M. Gorio; which provide toy construction sets in which the blocks are united by cooperating shaped members, as well as U.S. Pat. No. 4,214,403, patented Jul. 29, 1980, by J. N. Knudsen, which teaches a hinge element having cooperating pivot pins and bushings.

Thus, as noted above, many prior art building block toys have many obvious attractions and should not be criticised. However, there is always a demand for new building block toys which may offer different possibilities from those of the prior art. It is believed that the construction sets available on the market can be made still more versatile. For example, a wall may be constructed similar to bricks with the most popular blocks with interconnection on two faces. Although there are special pieces to expand in other directions, the blocks were not provided with an alternative for making a framed structure. On the other hand, while some construction sets provided good framing features, the individual pieces could not interlock to form a solid wall. It is also believed that most toy kits are limited since they could not be used to construct the many attractive polyhedral and spherical shapes shown in some geometry books.

SUMMARY OF THE INVENTION (a) Aims of the Invention

It is an object of the present invention to provide a novel construction toy which will offer an attractive alternative to various prior art building blocks.

It is also an object of the present invention to provide interconnecting building blocks that can be manufactured in thin-walled plastic, having a basically simple geometric shape which is capable of interlocking in different directions and capable of a choice of framing pieces.

It is a further object of the present invention to provide additional pieces of other shapes and forms with interconnecting means which are suitable for assembly, to enable the construction of many geometrical shapes, e.g., polyhedral and circular structures which will be highly educational and very entertaining.

(b) Statement of Invention

The present invention provides a toy construction kit comprising a plurality of modular components each having a central longitudinal axis for building three dimensional structures with a plurality of adjacent components interconnected to each other, the three dimensional structures including regular and Archimedean polyhedrons, the modular components comprising a plurality of different blocks including a sufficient selection of the following different interlockable blocks to enable the building of such three dimensional structures: (i) a plurality of primary blocks, in which the primary blocks each comprise prismatic blocks, each prismatic block having a four sidewalls, with each sidewall having a fixed length, the sideways each defining a dovetail connecting element extending parallel to the central longitudinal axis of the primary block. The ends of the sidewalls and of the dovetail elements define first and second end faces, with the dovetail connecting elements extending between the first end face and the second end face. The dovetail connecting elements comprise at least one dovetail recess and at least one dovetail tongue. The end faces include interior boundary walls which extend parallel to the central longitudinal axis of the primary block. The interior boundary walls support a central hollow cylindrical member, the central hollow cylindrical member and the interior boundary walls being no longer than the fixed length of the sidewalls; (ii) a plurality of vertex blocks, in which the vertex blocks each comprise prismatic blocks, each prismatic block having a four sidewalls, with each sidewall having a fixed length, the sidewalls each defining a dovetail connecting element extending parallel to the central longitudinal axis of the vertex block. The ends of the sidewalls and of the dovetail elements define first and second end faces, with the dovetail connecting elements extending between the first end face and the second end face. The dovetail connecting elements each comprise dovetail recesses. The end faces include interior boundary walls which extend parallel to the central longitudinal axis of the vertex block. The interior boundary walls support a central hollow cylindrical member, the central hollow cylindrical member and the interior boundary walls being no longer than the fixed length of the sidewalls; (iii) a plurality of hub blocks, with each of the hub blocks having a base end surface and a spaced-apart end surface. Each hub block has relatively-thin plastic exterior walls with three planar side surfaces defining male dovetail tongues. The planar side surfaces are mutually-angularly-disposed about a central longitudinal axis of the hub block by a selected edge angle. The planar side surfaces also converge at an acute selected wedge angle with respect to the base end surface. The end surfaces include interior boundary walls which extend parallel to the central longitudinal axis of the hub block. The interior boundary walls support a central hollow cylindrical member, the central hollow cylindrical member and the interior boundary walls being no longer than the length between the base end surface and the spaced-apart end surface; (iv) a plurality of wedge blocks, in which each wedge block has a base end surface and a spaced-apart end surface. The wedge blocks have relatively-thin plastic exterior walls with two planar front and rear surfaces and two planar side surfaces, the two planar side surfaces defining male dovetail tongues. The planar side surfaces are mutually-angularly-disposed about the central longitudinal axis of the wedge block, and converging towards each other at an acute angle with respect to the base end surface. The planar side surfaces also defining axes which intersect at an imaginary apex point, so that the spaced-apart end surface is located between the base end and the imaginary apex point. The wedge block further includes a recess which is provided between the base end surface and the spaced apart end surface and is bounded by the two planar front and rear surfaces and two planar side surfaces; (v) a plurality of three-way tapered hub blocks, with each three-way tapered hub block having a base end surface and a spaced-apart end surface, each three-way tapered hub block having relatively-thin plastic exterior walls with three planar side surfaces defining three male dovetail tongues. The planar side surfaces are mutually-angularly-disposed about the central longitudinal axis of the three-way tapered hub block by a selected edge angle. The planar side surfaces converge at an acute selected wedge angle with respect to the base end surface. The planar side surfaces also define axes which intersect at an imaginary vertex point, so that the spaced-apart end surface is located between the base end and the vertex point. The end surfaces include interior boundary walls which extend parallel to the central longitudinal axis of the three-way tapered hub block, the interior boundary walls supporting a central hollow cylindrical member. The central hollow cylindrical member and the interior boundary walls are no longer than the length between the base end surface and the spaced-apart end surface; (vi) a plurality of four-way tapered hub blocks, with each four-way tapered hub block having a base end surface and a spaced-apart end surface. Each four-way tapered hub block has relatively-thin plastic exterior walls with four planar side surfaces, the four planar side surfaces defining male dovetail tongues. The planar side surfaces are mutually-angularly-disposed about a central longitudinal axis of the four-way tapered hub block by a selected edge angle. The planar side surfaces converge at an acute selected wedge angle with respect to the base end surface. The planar side surfaces also define axes which intersect at an imaginary vertex point, so that the spaced-apart end surface is located between the base end and the imaginary vertex point. The end surfaces include interior boundary walls which extend parallel to the central longitudinal axis of the four-way tapered hub block, the interior boundary walls supporting a central hollow cylindrical member. The central hollow cylindrical member and the interior boundary walls are no longer than the length between the base end surface and the spaced-apart end surface; and (vi) a plurality of five-way tapered hub blocks, with each five-way tapered hub block having a base end surface and a spaced-apart end surface. Each five-way tapered hub block has relatively-thin plastic exterior walls with five planar side surfaces, the five planar side surfaces defining five male dovetail tongues. The planar side surfaces are mutually-angularly-disposed about the central longitudinal axis of the five-way tapered hub block by a selected edge angle. The planar side surfaces converge at an acute selected wedge angle with respect to the base end surface. The planar side surfaces also define axes which intersect at an imaginary vertex point, so that the spaced-apart end surface is located between the base end and the imaginary vertex point. The end surfaces include interior boundary walls which extend parallel to the central longitudinal axis of the five-way tapered hub block, the interior boundary walls supporting a central hollow cylindrical member. The central hollow cylindrical member and the interior boundary walls being no longer than the length between the base end surface and the spaced-apart end surface.

(c) Other Features of The Invention

By one feature of the invention, the recess of the wedge block is divided by an interior wall which extends in a normal direction between the base end surface towards the spaced apart end surface, and by another feature of the invention, the recess in the wedge block supports a central hollow cylindrical member; and/or by another feature of the invention, the central hollow cylindrical member includes at least two radially-extending longitudinal slots, each such radially-extending longitudinal slot having a radial inner web portion which is spaced about the central longitudinal axis, wherein the recess serves as an axially-receptive recess for connecting with an axial connecting member.

By another feature of the invention, at least some of the female dovetail grooves have chamfered end faces; and/or by another feature of the invention, at least some of the male dovetail tongues are provided with chamfers adjacent to each side face.

By yet another feature of the invention, each of the end faces includes a recessed abutment area which is disposed radially-inwardly from the lateral sides.

By yet still another feature of the invention, the male dovetail tongues of the wedge block are defined by two side surfaces which are disposed at a 180° wedge angle about the central longitudinal axis of the wedge block and which converge towards the imaginary apex; and/or by yet still another feature of the invention, the male dovetail tongues of the wedge block are defined by two side surfaces which are disposed at a wedge angle which is less than 180° about the central longitudinal axis of the wedge block and which converge towards the imaginary apex, thus defining an offset wedge block.

By still yet a farther feature of the invention, the each primary block and/or each vertex block has a geometry in accordance with the formula:

$$A+B=C$$

and $$A+B+C=D$$

wherein

A is a distance from one edge of a dovetail tongue or a dovetail groove at a mid-height or a mid-depth to an adjacent edge of a nominal square;

B is a distance from an opposite edge of the dovetail tongue or the dovetail groove at a mid-height or a mid-depth to an adjacent edge of a nominal square;

C is a width of the dovetail tongue or the dovetail groove at a mid-height or a mid-depth; and D is a nominal square of side D defined by nominal lines drawn parallel to the side faces through mid-height or mid-depth points.

By yet still another feature of the invention, the kit further includes adapter pieces having two generally parallel faces, the faces of the adapter pieces having interconnecting means, which are either a pin which is parallel to a face of the piece, or is a sleeve which is parallel to a face of the piece, or is a male dovetail on a face of the piece, or is a female dovetail on a face of the piece, or is a tongue having a rectangular cross section projecting from a face of the piece, is a or a tongue having an I-shaped cross section from a face of the piece, or is a tongue having a circular cross section projecting from a face of the piece. By a specific feature of this feature of the invention, the adapter pieces include pieces having two dovetail surfaces; and/or the adapter pieces include pieces comprise a dovetail tongue on a face of the piece; and/or the adapter pieces include pieces comprising two faces, each face having a male dovetail tongue running therealong, and in which the faces are disposed about their common axis and converge towards an imaginary apex point; and/or in which the adapter pieces comprise a plurality of elongated connectors, the elongated connectors being sized and shaped to engage with axially-receptive elements on other modular components; and/or in which the adapter pieces comprise a plurality of elongated connectors, the elongated connectors being sized and shaped to engage with axially-receptive elements on other modular components and being at least four times longer than an exterior length of the modular components; and/or in which the adapter pieces comprise a plurality of cylindrical connectors, the cylindrical connectors being sized and shaped to engage with axially-receptive elements on other modular components; and/or in which the adapter pieces comprise a plurality of cylindrical connectors, the cylindrical connectors being sized and shaped to engage with axially-receptive elements on other modular components, the cylindrical connectors being at least four times longer than an exterior length of the modular components; and/or in which the adapter pieces are sized and shaped to engage with axially-receptive elements on other interlockable blocks triangular pieces to form a six sided hub piece; and/or in which each adapter piece has a male dovetail tongue to support thin-walled panels, the panels including curved surfaces.

By yet still a further feature of the invention, the toy construction kit further includes at least two adapter pieces for hinged connection between any of the modular components, one of the adapter pieces having a pin projecting therefrom, and another of the adapter pieces having a sleeve for engagement with the projecting pin.

By yet still another feature of the invention, the toy construction kit further includes building pieces, in which each of the building pieces has a face with an axially-receptive recess; and/or in which the construction kit further includes building pieces having a face with an axially-receptive recess, with a portion of the face being recessed.

By still a further feature of the invention, the kit further includes axial connecting members which comprise rectangularly-shaped panels having edges which are adapted to be inserted into receptive recesses which are provided in, or by, a plurality of interconnected blocks; and/or further including axial connecting members which comprise thin-walled panels, the thin-walled panels being either planar or including curved surfaces; and/or further including axial connecting members which comprise thin-walled panels having perforated openings therethrough, the thin-walled panels being either planar or including curved surfaces; and/or farther including axial connecting members which comprise thin-walled panels having perforated openings therethrough, the thin-walled panels being either planar or including curved surfaces in combination with a plurality of connecting members which are provided with a cylindrical projection for engagement through the perforated openings and into the central hollow cylindrical members of the modular elements; and/or in which the panels include indicia in the form of printed matter.

By yet a further feature, the blocks may be used in conjunction with tubular or framing connectors with an I-shaped cross section, or other connectors, including tongues projecting from other blocks and specially configured connectors, connectors advantageously being usable in conjunction with craft sticks, of dimension about ¾ inch by about 1/16 inch by about 6 inches.

By still yet another feature of the invention, the toy construction kit includes a hub structure which is defined by a plurality of offset wedges and prismatic blocks with dovetail connecting faces which are disposed in an interlocking relationship.

By yet another feature of the invention, a minimum of twelve prismatic blocks are interconnected with a minimum of eighteen hub assemblies comprising: six more prismatic blocks each having four lateral sides in a square configuration with female dovetail grooves which are connected to four wedge blocks with male dovetail tongues converging at a 45° angle and positioned at right angles about a common axis towards the centre point of a dual polyhedra; twelve of the tapered hub assemblies each being provided with three male dovetail tongues converging at an angle of 35° 16' equally positioned about a common axis toward the centre point of the dual polyhedra; and the blocks are interconnected in a spherical shape so as to define a complete dual polyhedra in the configuration of a cube and a regular octahedron.

By a specific feature of that feature of the invention, axially-receptive recesses are provided on the prismatic blocks and tapered hubs for accommodating axial connecting members having two ends, and the axial connecting members define at least twenty-six vectors from a centre of the polyhedra, the interconnecting means thus being provided for interconnecting full and partial assemblies of the polyhedra with similar assemblies in three dimensional tessellation, by using the axial members with lengths determined by traditional geometrical constants.

(d) Generalized Features of the Invention

In agreement with the nature of the structural assembly with reference to embodiments of the invention, the present arrangement begins from a cubical self-joining feature (which can be referred to as the primary blocks) which can be interconnected to form a larger three-dimensional planar surface. The blocks are not only self-interlocking but also have an extra capacity to use framing pieces and interconnecting pieces which are supplied with either a tubular or I-shaped cross-section or other interconnecting elements (e.g., plate-sections with appropriate tongues and compatible supports) including craft sticks, which may be of dimensions about ¾ inch by about 1/16 inch by about 6 inches, and also rounded wood-doweling of diameter about ½ inch. These supplemental options which are currently available will be of particular interest for children.

The invention in its various embodiments, includes a number of the primary blocks and other specifically designed pieces and connectors with interlocking capability. These pieces, with connectors, are provided in kit form.

At minimum, the primary blocks preferably have one or more faces which are designed with apertures to receive a connector or elongated framing projection with rounded ends or I-shaped cross section. For example, craft sticks (having dimensions about ¾ inch by about 1/16 inch by 6 six inches), can also be used. Other faces also incorporate means for joining blocks to each other to form larger building configurations.

Other interconnectors may include a pin projecting from one part which is particularly sized to engage a sleeve which is incorporated in another part, for hinged union so that blocks may rotate with respect to each other. This pin and sleeve combination is slightly tapered so that a snug fit is achieved at full engagement, (referred to as male hinge and female hinge piece).

The interconnectors could also alternatively include a male dovetail tongue on one part which is particularly sized to engage a female groove elsewhere. That connection will enable one block successfully to engage with another.

In one configuration, the block is triangularly-shaped, (referred to as triangle block), and has the unique advantage of interlocking with similar ones to form a circular array. A hexagon with a circular aperture, which is derived from this construction, is sized to engage the other rounded framing pieces of the kit. This offers an interlocking means for other pieces to radiate at various angles, In another configuration, dovetail connections, which are arranged on the sides of the block, provide an alternate advantage allowing them to be interconnected in overlapping fashion, forming a matrix that structures the base for a self-expanding array.

A wedge-shaped block (referred to as wedge block) is included that can interconnect two primary blocks at a regular angle and a circular array may be formed when the pattern is continued. Some blocks (referred to as vertex block) may be added to the kit, such vertex blocks being suitably designed to interconnect additional circular arrays offset around a common centre to form vertices. This can form the greater circles of a sphere.

Because of the specific design of the primary block (having interlocking faces circumferentially arrayed on four sides) it is now possible to develop an expansion in three-dimensions by appropriate angular manipulation of an elementary geometrical form. This is accomplished by a combination of the primary block and specifically shaped interconnecting pieces, e.g., hubs containing tapered faces (referred to as tapered hub) radiating from a focal vertex through multiple spatial axes similar to the aforementioned spherical shape using wedge blocks. Also supplied are offset wedge blocks (referred to as offset-wedge blocks). The offset-wedge blocks when used with other building pieces can be particularly useful for building configurations, e.g., regular and semi-regular polyhedra. This application could also construct geodesic domes and spheres.

Assemblies of blocks can be further enhanced by using various panels to form walls, and polyhedral shapes can be enclosed with shell-shaped pieces to form spheres.

For convenience, the specification will refer to framing pieces. However, it should be clearly understood that this is intended to include any sticks having substantially the same general shape and dimensions as a craft stick and for that matter, any other connector or elongated framing piece which could be engaged in the apertures within the blocks. As will be clear from the detailed description, craft sticks are just one example of the connectors which may be used. Connectors having an I-shaped cross-section could be used. Also, a tubular plastic framing piece may be used, or various cross-section wooden framing pieces with rounded ends as another example.

Also, the word "block" will be used generally for convenience, although the word "piece" will be used interchangeably. The word "piece" is perhaps more accurate, since not all of the pieces are shaped like a "block." Use of the word "block" is not intended to limit the invention to pieces which are shaped like a "block."

BRIEF DESCRIPTION OF THE DRAWINGS

In the accompanying drawings:

FIG. 19 shows how angles are configured for the faces of a tapered hub using the outline of a tetrahedron;

FIG. 20*a* shows the top view of the tapered hub shown in FIG. 19;

FIG. 20*b* shows the side view of the tapered hub shown in FIG. 20*a;*

FIG. 21 shows an alternative angle configuration for the same size hub as in FIG. 19 but using the outline of a cube;

FIGS. 22*a*–22*b* shows another example of a tapered hub connector but uses a 4 way configuration;

FIGS. 23*a*–23*b* is similar to the hub piece as shown in FIG. 22*a*–22*b* but uses a 5-way configuration;

Figure 1:
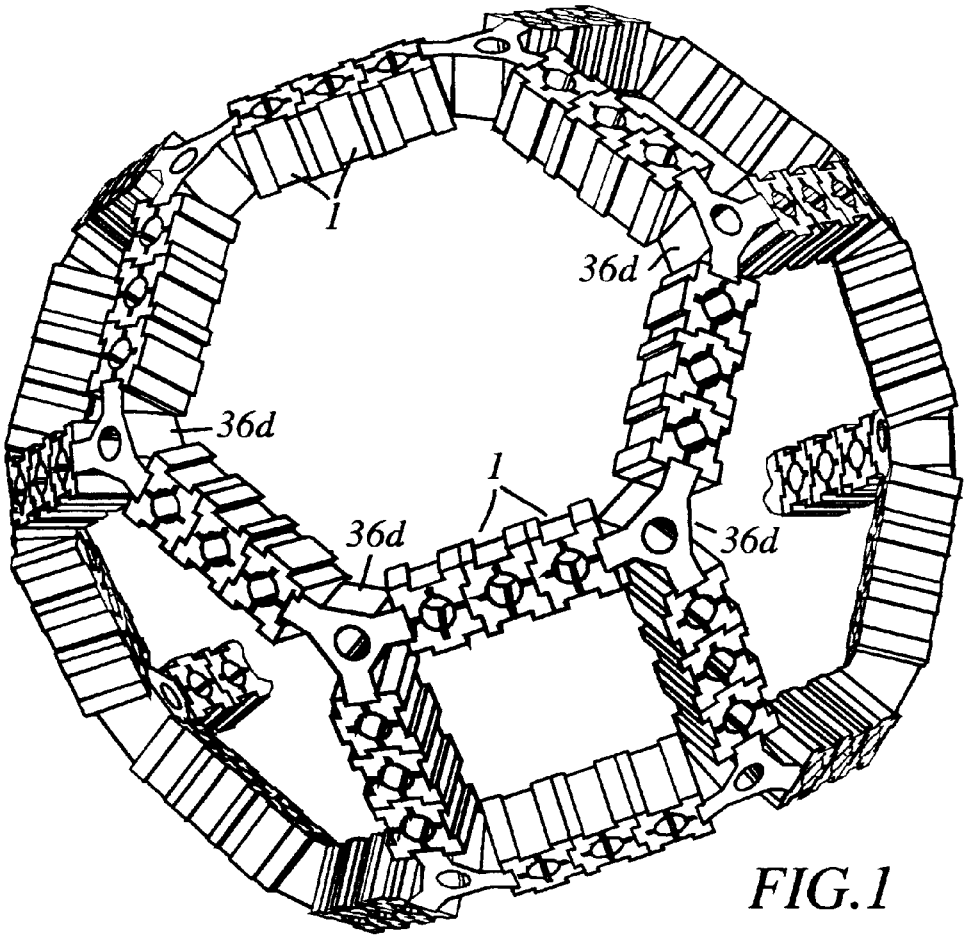
FIG. 1 is an illustrative view of a polyhedral figure constructed with primary blocks and tapered hubs.

DESCRIPTION OF PREFERRED EMBODIMENTS (a) Description of FIG. 1

Reference is now made to FIG. 1 which is an illustrative view of a typical semi-regular polyhedron, namely a truncated octahedron which is constructed with modular components in accordance with an embodiment of the present invention. The device is constructed by a combination of two different building pieces consisting of a primary block 1 and a tapered hub block 36*d*. It can be seen that the tapered hub blocks 36*d* are interlocked with the primary blocks 1 conically around each vertex of the polyhedron. The polyhedron can also be increased in size by adding more of the blocks uniformly to each face without changing the overall shape. This embodiment of the invention is not restricted to the use of these blocks. For example, a customised piece, designed with two end connection means, could replace a string of primary blocks.

Figure 2A:
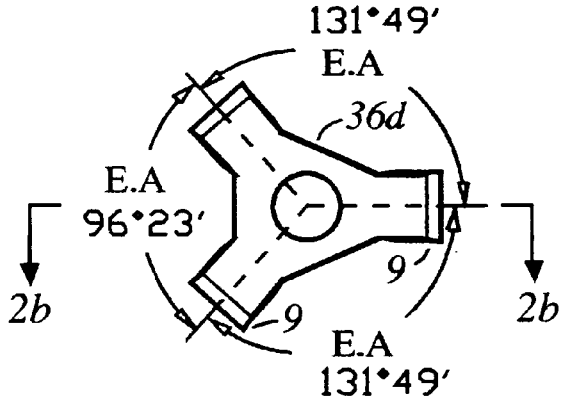
FIG. 2*a* is a top view of a tapered hub interconnecting piece as used in FIG. 1.
Figure 2B:
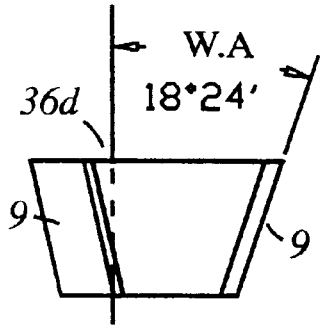
FIG. 2*b* is a side view of the tapered hub that is shown in FIG. 2*a;*

(b) Description of FIGS. 2*a* and 2*b*

FIG. 2*a*, shows the top view of a hub block 36*d* and FIG. 2*b* shows its side view. As the polyhedron being shown is made up of hexagons and squares, the angles among the three edges at the vertex varies. This angle is referred to as edge angle (E.A.). FIG. 2*a* shows the E.A. displayed between the male dovetails 9 and it shows a typical configuration of 131° 49' between the two hexagon sections and the section making up the square being 96° 23', these angles being configured around a vertex line to the centre of the polyhedron. FIG. 2*b* also shows a wedge angle (W.A.). these two angles will be described in detail in the description of FIG. 19 hereinafter.

Figure 3C:
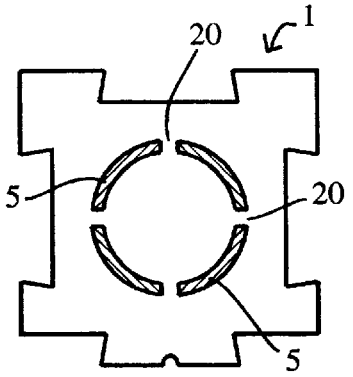
FIG. 3*c* is an outline of the primary block as shown in FIG. 3*a* and showing the area for ejecting the block out of a mould.
Figure 3A:
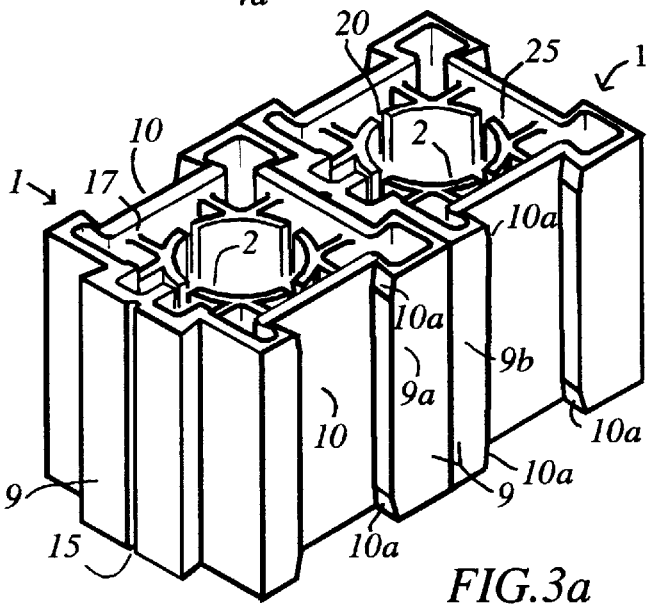
FIG. 3*a* is a perspective view of two primary blocks interlocked together.
Figure 3B:
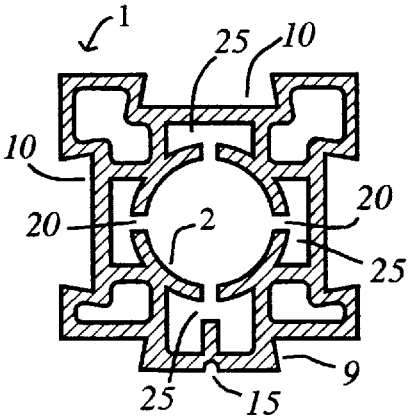
FIG. 3*b* is a cross-sectional view of a primary block as shown in FIG. 3*a;*

(c) Description of FIG. 3*a*. FIG. 3*b* and FIG. 3*c*

FIG. 3*a* is a perspective view of two primary blocks 1 interlocked together, the blocks each having one male dovetail tongue 9 and three female dovetail grooves 10, each female dovetail groove being chamfered at the openings 10*a* to ease location for a slide fit. The blocks have the unique feature of being able to form a new dovetail 9 tongue from two correctly configured portions 9*a*, 9*b*,(see FIG. 12*b*) of the two blocks.

FIG. 3*b* is a cross-sectional view of the block 1 and shows in more detail the shape of the aperture that passes through the two end faces. The circular opening 2 is split by four slots 20 and forms a T-shape 25, thus providing the block with the ability to receive a narrow rectangular or I-shaped connector piece, in any of four orientations at a 90° angle to each other. Such block can also receive a cylindrical connector piece in the opening 2, to give the block the unique advantage of receiving the choice of three different shaped connector pieces. The male dovetail tongue 9 of these blocks is shown with a split, 15. The purpose of the split is to provide a little flexibility in the male dovetail tongue, for a smoother fit into the female dovetail groove.

The profile as depicted in FIG. 3*c* could be used for extrusion for longer pieces. FIG. 3*c* shows the outline of the primary block 1 which is shown in FIG. 3*b*. The four portions 5 make up the preferable area for a customised ejector tube which is slotted at 20, to push against the plastic block enabling ejection from its mould-base.

Figure 4:
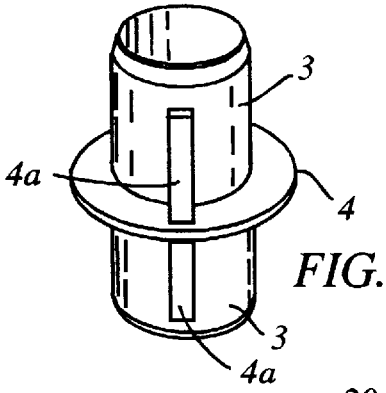
FIG. 4 is a perspective view of a circular connector piece for use with the primary blocks shown in FIG. 3*a*.

(d) Description of FIG. 4

FIG. 4 is a perspective view of a cylindrical connector piece. Cylindrical portion 3 is sized to fit the cavity 2 in the block 1. A circular plate 4 is provided to be accommodated within the recessed area 17 of the primary block, so that blocks can abut each other directly, rather than be separated by the thickness of the plate portion 4. A longitudinally-extending tongue 4*a* is also shown, which is to locate the slot 20 of the blocks, thus preventing the blocks from rotating with respect to each other when interconnected.

Figure 5A:
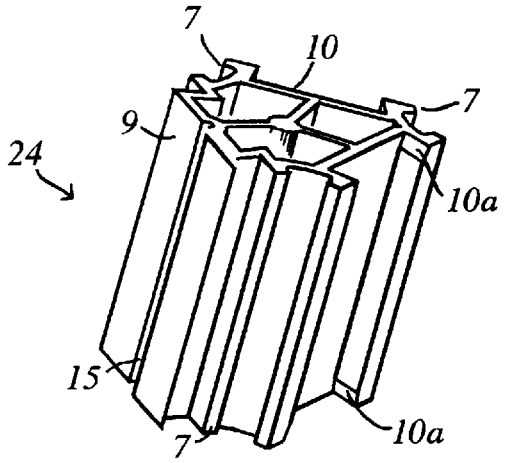
FIG. 5*a* is a perspective view of a triangle block with interlocking means on three sides.
Figure 5B:
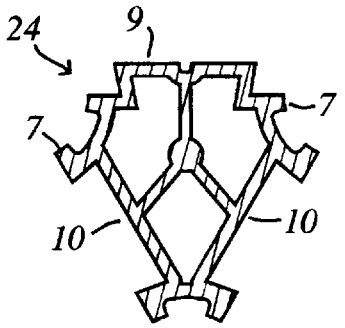
FIG. 5*b* is a cross-sectional view of the triangle block as shown in FIG. 5*a;*

(e) Description of FIG. 5*a* and FIG. 5*b*

FIG. 5*a* is a perspective view of a triangle block 24, which has two faces with female dovetail grooves 10, the ends of the grooves being chamfered 10*a* to ease assembly, the third face being a male dovetail tongue 9. Each corner of that block is arched 7 to provide a circular aperture when six blocks are interconnected to form a hexagon piece, (see FIG. 12*a*). FIG. 5*b* shows a cross-sectional view of the triangle block 24 as shown in FIG. 5*a*.

Figure 7:
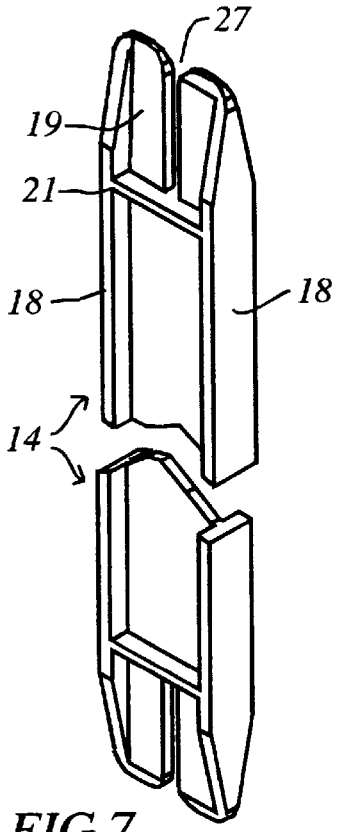
FIG. 7 is a perspective view of an elongated connector which is I-shaped in cross-section.
Figure 6:
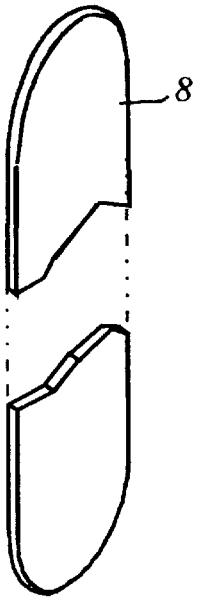
FIG. 6 is a perspective view of an elongated connector piece which is commonly referred to as a craft stick.

(f) Description of FIG. 6 and FIG. 7

FIG. 6 is a perspective view showing a craft stick 8 and FIG. 7 shows another elongated connector piece 14 which is I-shaped in cross-section. The reinforcing side walls 18 are used to strengthen the connector piece if it is manufactured in thin-walled plastic. A plate portion 21 spans between the side walls, and is intended to abut the block. Elongated portions 19, which is divided by slit 27, extend longitudinally beyond the plate portion 21 to provide the ends of connector piece 14.

Figure 8B:
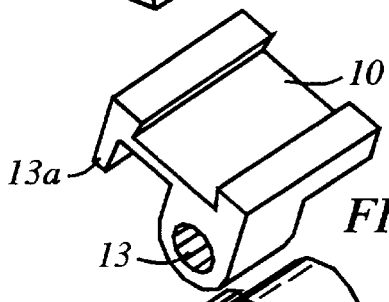
FIG. 8*b* is a perspective view of a female hinge piece.
Figure 8A:
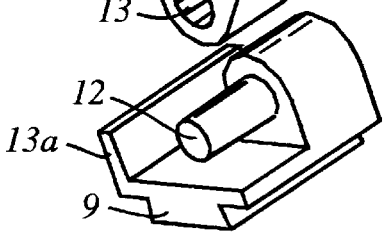
FIG. 8*a* is a perspective view of a male hinge piece.

(g) Description of FIG. 8*a* and FIG. 8*b*

FIG. 8*a* and FIG. 8*b* are male and female hinge pieces, one having a pin and the other having a corresponding sleeve. A male pin 12 is offset from one block, and is adapted to mate with a female sleeve 13 which is incorporated into the other block. The pin and sleeve are slightly tapered such that a snug fit is achieved at fall engagement between the pin and the sleeve. Female dovetail groove 10 and male dovetail tongue 9 are also provided, although other forms of connection could be used if desired. A portion 13*a* is provided to act as a stop to limit the hinge swing and to align the hinges when closed. The stop 13*a* can be eliminated, if preferred, and pin 12 and sleeve 13 may be positioned to give a swing equally in both directions.

Figure 11:
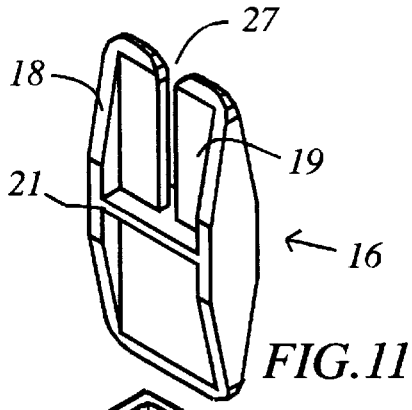
FIG. 11 is a perspective view of a short connector piece of I-shaped cross-section.
Figure 10:
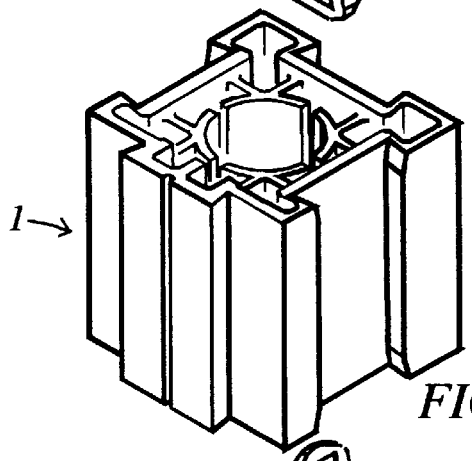
FIG. 10 is a perspective view of another primary block similar to FIG. 3*a;*
Figure 9:
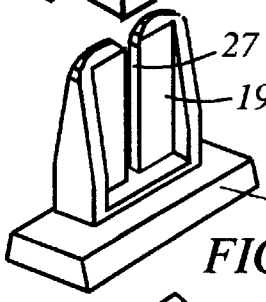
FIG. 9 is a perspective view of a tongue to male dovetail interconnecting piece.

(h) Description of FIG. 9. FIG. 10 and FIG. 11

FIG. 9 is a perspective view of a connector having a transverse tongue 9 and a longitudinal tongue 19 and shows a split 27. FIG. 10 shows another primary block 1 and FIG. 11 shows a short connector piece 16 which is I-shaped in cross-section. It is essentially a short version of the elongated connector piece 14 shown in FIG. 7. Preferably the tongue 19 is split at a slot 27. Thus, as seen from FIG. 9 to FIG. 11, two connector pieces may be inserted in opposite ends of the same block, at a 90-degree angle to each other.

Figure 12B:
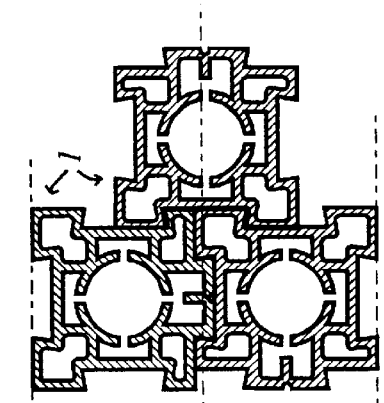
FIG. 12*b* is a cross-sectional view of a matrix of primary blocks.
Figure 12A:
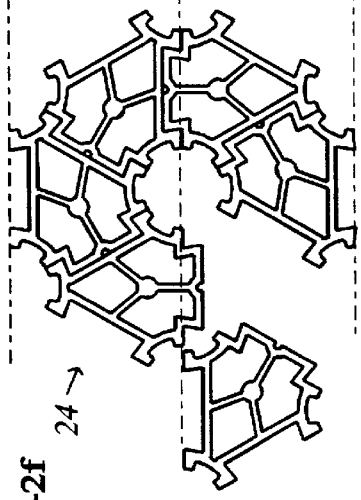
FIG. 12*a* is a cross-sectional view of a circular array of triangular blocks similar to the block shown in FIG. 5*b;*

(i) Description of FIG. 12*a* and FIG. 12*b*

FIG. 12*a* is a cross-sectional view of a circular arrangement of triangle blocks 24 and FIG. 12*b* is an arrangement of primary blocks 1, to demonstrate that the measurements of both groups of blocks have similar outer dimensions. The three primary blocks 1 are interlocked to form a matrix.

Figure 13A:
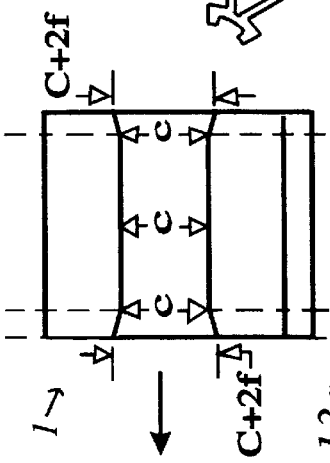
FIGS. 13*a*, 13*b* and 13*c* shows how the dovetail faces of the primary blocks are configured for the matrix shown in FIG. 12*b;*
Figure 13C:
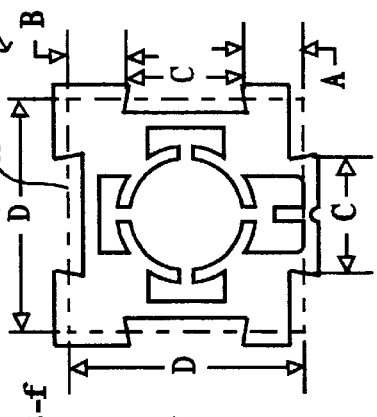
Figure 13B:
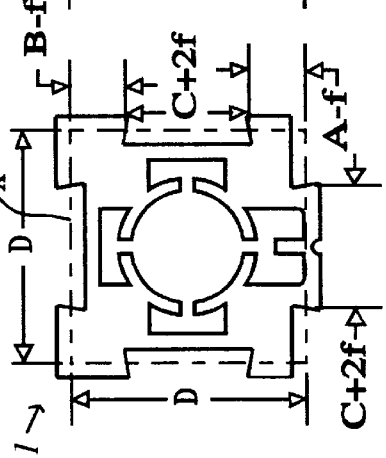

(i) Description of FIG. 13*a*. FIG. 13*b* and FIG. 13*c*

FIG. 13*a* to FIG. 13*c* show how the dimensions of the primary blocks 1 are configured to form a new dovetail tongue 9 from two correctly configured portions 9*a*, 9*b*, (see FIG. 3*a*) of the two blocks.

FIG. 13*a* shows a side view of primary block 1 and dimension C is the mid-height or mid-depth distance across the female dovetail groove. The female dovetail groove 10 is chamfered at both openings 10*a* and the mid-height or mid-depth distances at the outside edges are defined as C+2f in which f is the distance of the chamfer at 10*a*. FIG. 13*b* and FIG. 13*c* show how the dimensions of the block are defined as follows. A nominal square of the side dimension D is defined by nominal lines drawn parallel to the side faces through mid-height or mid-depth points of the dovetail tongues or dovetail grooves as the case may be. The further dimensions of the block, as illustrated in FIG. 13*c*, are in accordance with the formula:

$$A+B=C$$

$$A+B+C=D$$

where A is the distance from one edge of a dovetail tongue or a dovetail groove at the mid-height or mid-depth thereof to its adjacent edge of the nominal square; B is the distance from the opposite edge of the dovetail tongue or the dovetail groove at the mid-height or mid-depth thereof to the adjacent edge of the nominal square; and C is the width of the dovetail tongue or the dovetail groove at mid-height or mid-depth thereof. Each dovetail tongue or dovetail groove is centred on the face of the nominal square, D being the length of each side of the square.

Further analysis of the above shows that A=B, and thus that 2A=C, or 2B=C, or 4A=D, or 4B=D, etc. It should be emphasized that these dimensions are all nominal, rather than precise. In practice, sufficient allowance must be made for normal tolerances and for drafts in the mold to ensure that the mold can come apart and that the parts will engage each other without either too much or too little friction or play.

FIG. 13*b* illustrates how increasing the distance C by an amount f, drastically alters the configuration and the amount which are added onto a female dovetail groove is reduced on the male dovetail portions, making a loose fit.

Figure 14A:
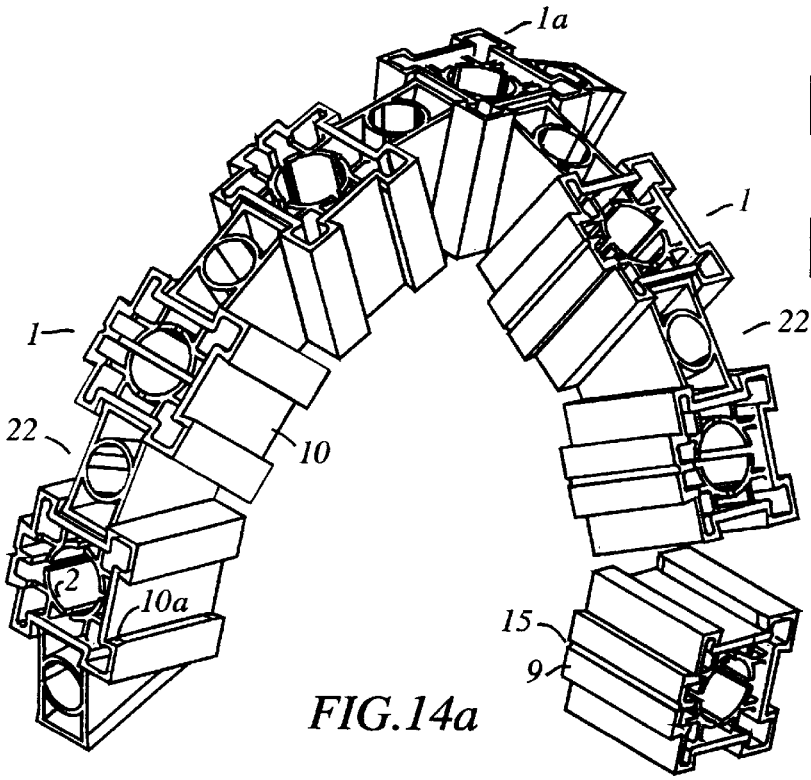
FIG. 14*a* is a perspective view of an assembly of wedge blocks and primary blocks using a four-way vertex block.
Figure 14C:
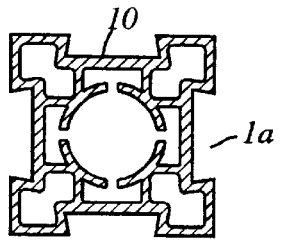
FIG. 14*c* is a cross-sectional view of a vertex block shown in FIG. 14*a;*
Figure 14B:
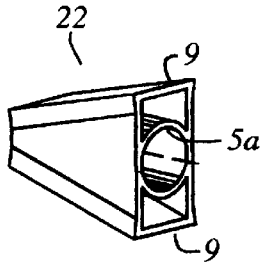
FIG. 14*b* is a perspective view of a wedge block as shown in FIG. 14*a;*

(k) Description of FIG. 14*a* and FIG. 14*b*

Figure 14D:
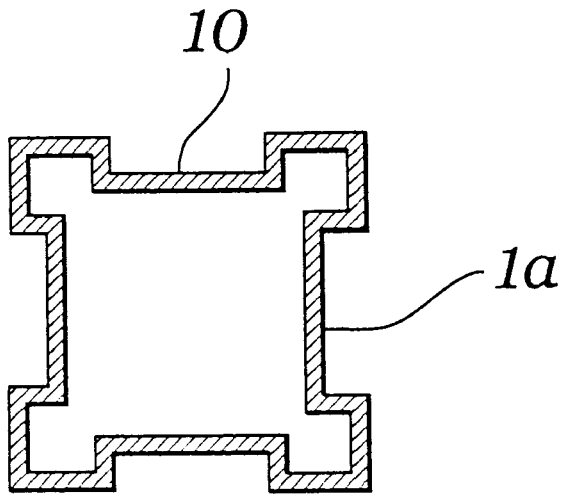
FIG. 14*d* is another choice of coring to that in FIG. 14*c;*
Figure 14E:
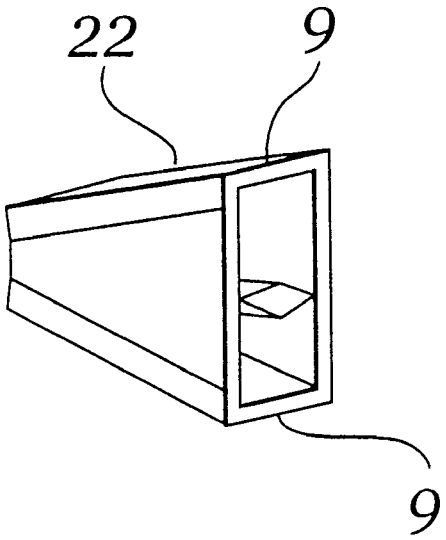
FIG. 14*e* is a view similar to FIG. 14*b*, but showing an embodiment of the wedge block without the circular portion.

FIG. 14*a* is a perspective view showing a configuration of primary blocks 1 and wedge blocks 22. The wedge block 22 also shown in FIG. 14*b* is provided with two male dovetail tongues 9 on two opposite faces, decreasing in an acute angle. The wall thickness of the block is designed to use thin-walled plastic and may be ejected out of a mold by pushing around the circular portion of the block 5*a*. (Other bracing shapes could also be used) The block 1*a* acts as the vertex block similar to the primary block 1 but contains all female connection means 10 as shown in the cross-sectional view FIG. 14*c* or 14*d*. FIG. 14*d* is another choice of coring to that of FIG. 14*c*. FIG. 14*e* is a view similar to FIG. 14*b*, but showing an embodiment of the wedge block 22 with a central brace or wall extending between the two side walls in place of the circular portion 5*a*. The wedge block 22 of FIG. 14*e* would be a closed structure. These end views of 1*a* are ideal shapes for extruding longer pieces of the same profile. It is easy to form the greater circles of a sphere by using the vertex blocks and assembling two or more circular arrays of blocks. The vertex block could be provided with three or numerous female connection faces other than the four shown in FIG. 14*c*.

Figure 15A:
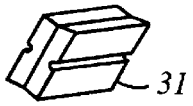
FIG. 15*a* is a perspective view of a dovetail interconnecting piece.
Figure 15B:
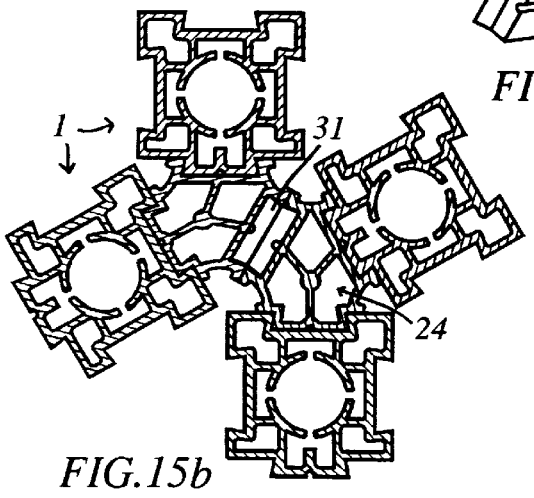
FIG. 15*b* is a view showing primary blocks and triangle blocks in a 60-degree and 180-degree configuration using a dovetail interconnecting piece.
Figure 15C:
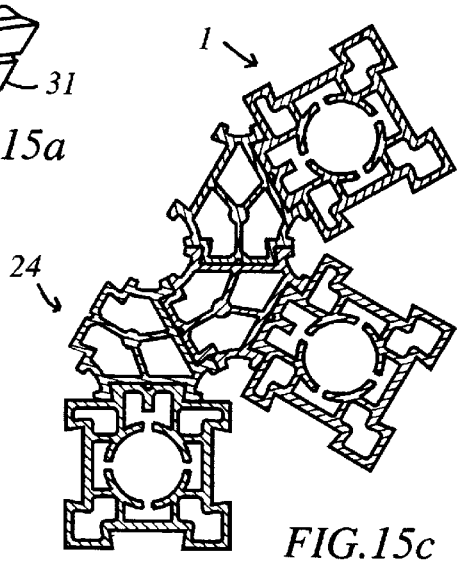
FIG. 15*c* is another configuration of triangle and primary blocks.

(l) Description of FIG. 15*a*, FIG. 15*b* and FIG. 15*c*

FIG. 15*a* illustrates a male-to-male dovetail connector piece 31, referred to as male-to-male connector.

FIG. 15*b* shows an arrangement of four primary blocks 1 that can be connected in a combination of 60° and 120° angles by using two triangle blocks 24 and a male-to-male connector 31.

FIG. 15*c* shows more variations using a combination of primary blocks 1 and triangle blocks 24. There can be numerous variations of structures to be achieved with these blocks.

Figure 16:
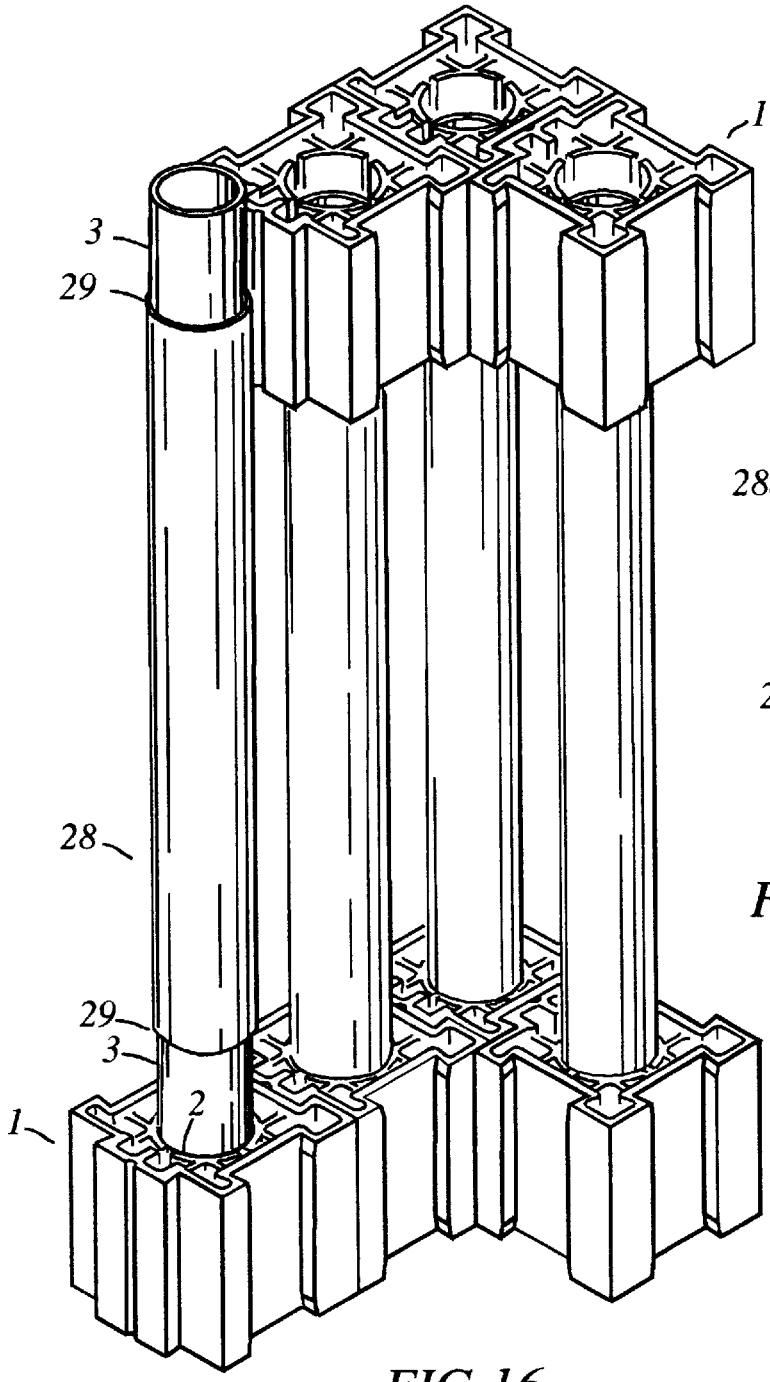
FIG. 16 is view of primary blocks using framing pieces of circular cross-section.

(m) Description of FIG. 16

FIG. 16 illustrates an arrangement of primary blocks 1 with elongated cylindrical framing connector pieces 28. An optional shoulder 29 is provided on the connector piece 28 and ends 3 are sized to fit the aperture 2 of the primary blocks 1. The framing pieces 28 may be manufactured from tubular plastic, or from solid wood doweling.

Figure 17A:
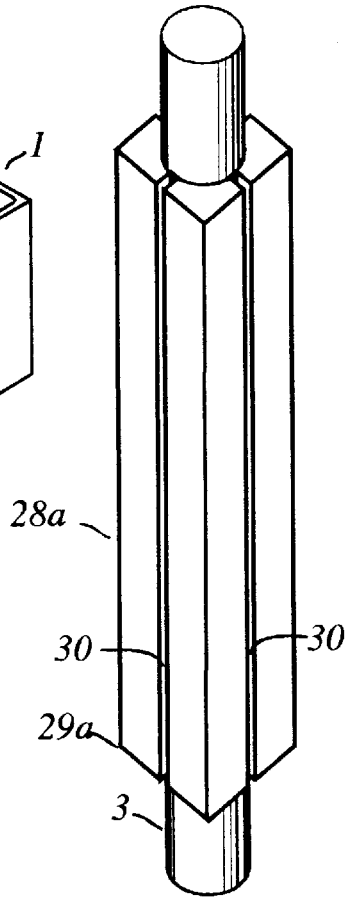
FIG. 17*a* is a perspective view of a wooden framing piece with an alternate shaped body as used in the assembly shown in FIG. 18.
Figure 17B:
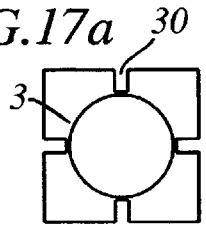
FIG. 17*b* shows the end view of FIG. 17*a;*

(n) Description of FIG. 17*a* and FIG. 17*b*

Figure 17C:
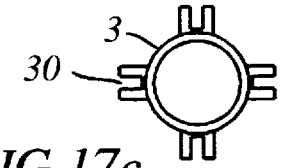
FIG. 17*c* shows the end view of FIG. 17*a*, if the framing piece were to be made of plastic.

FIG. 17*a*, being a perspective view, and FIG. 17*b*, being the end view, illustrates an alternate elongated framing piece with similar end connections 3 and provided with a shoulder 29*a* which uses a square parallelepiped section 28*a* that can be made from wood. The square parallelepiped section 28*a* is customised with slots 30 which can be used to support a thin rectangular plate if desired. The previously mentioned elongated framing pieces may have other configurations to support boards or plating sections at other angles if desired. FIG. 17*c* shows the end view of a customised connector similar to FIG. 17*a* and FIG. 17*b* designed for manufacturing in thin-walled plastic.

Figure 18:
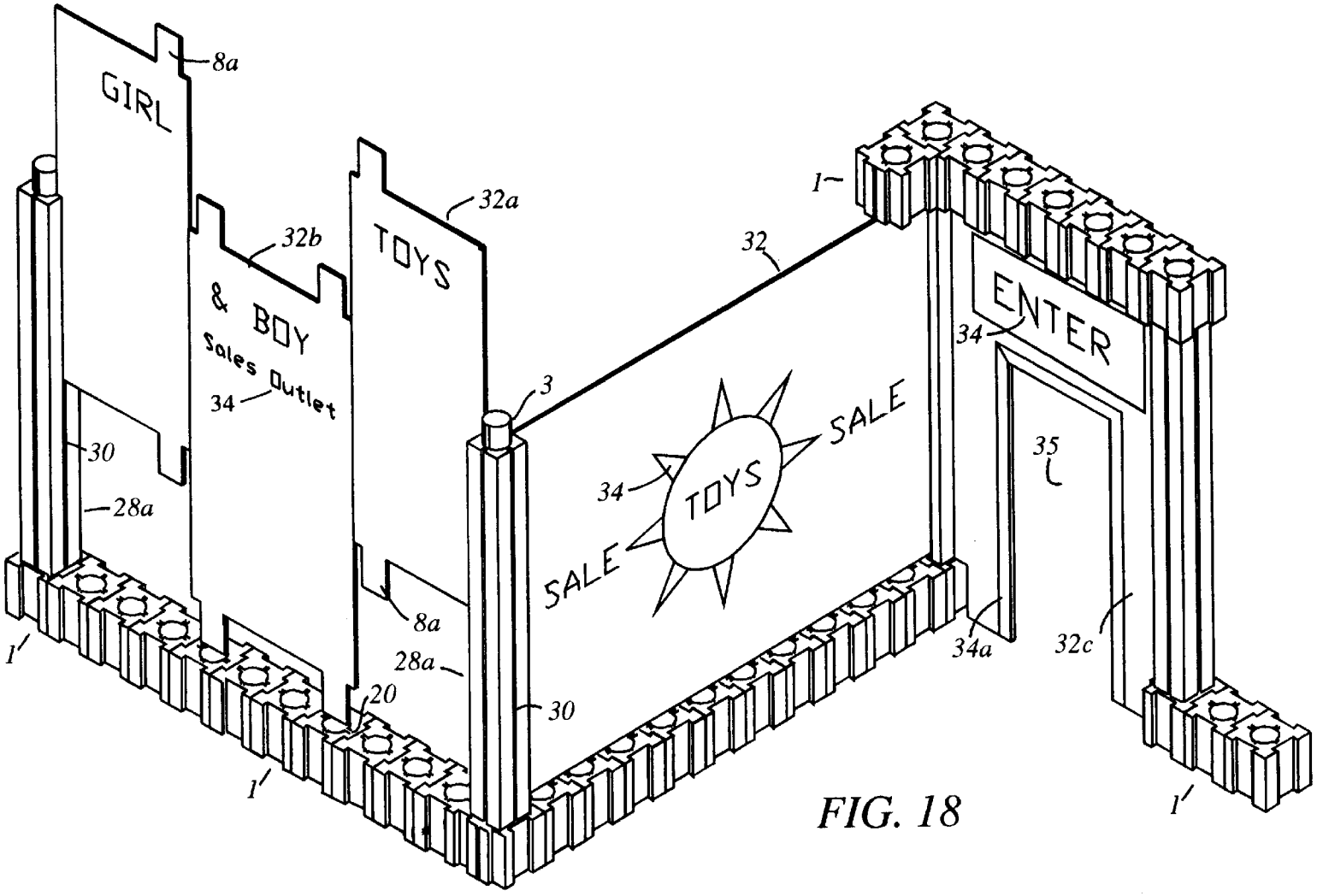
FIG. 18 is a perspective view of a miniature store constructed with blocks and framing pieces.

(o) Description of FIG. 18

FIG. 18 is an illustration of a modular structure using interlocking primary blocks 1 and the use of framing pieces 28*a* to support plate sections 32, 32*a*, 32*b* and 32*c* to form a structure of, e.g., a miniature toy store. The framing pieces 28*a* are slotted 30 on all four sides to receive the edges of the plate sections 32. The plate sections 32 may be inserted between two framing pieces as shown with plate section 32, or the plate section 32*c* may be shaped to form a doorway 35, or if desired, the plate section could be customised to provide a window opening. The plates may also be supported by additional tongues 8*a* that may be inserted into the cavities 20 of the primary blocks 1 (see FIG. 3*b*). The plates sections may be illustrated 34 (door-frame 34*a*) by printing or decals and may use transparent plastic to make shop windows. The boards may also be illustrated by children using coloured pens.

(p) Description of FIG. 19, FIG. 20, FIG. 20*a*, FIG. 20*b* and FIG. 21

Reference is now made to FIG. 19, FIG. 20*a*, FIG. 20*b* and FIG. 21, which provide more detail for configuring the tapered hub which is instrumental in the construction of polyhedra. A simple cube and tetrahedron are good examples for using a tapered hub combination. Beginning with the outline of the tetrahedron 38 shown in FIG. 19, the three male connecting tongues 9 of the tapered hub 36*a* radiate congruently around the axis from the centre 39 and the vertex 41 of this polyhedron. These three faces 9 will converge towards the vertex 41 and interconnect primary blocks 1 to be perfectly aligned with the outer edges of 40*a*, 40*b*, 40*c*, 41 of the tetrahedron and in a triangular plane 40*a*, 41 to the centre 39. The converging angle is referred to as wedge angle (W.A.)and is configured as ½(180°- centre angle) which is ½ (180°–109°28'), thus being an angle of 35°16'. The centre angle (C.A.)(designated theta) is shown at the centre 39 of the tetrahedron 38 subtended by its edge 40a–41.

It is interesting to note that the centre angle of a tetrahedron, being 109°28' is the supplementary angle to that of a cube which is 70°32'. Therefore, by rotating the tapered hub 36*a* end for end, they may be used for both polyhedra but the blocks are oriented at a 90° angle in the latter interconnections as shown in FIG. 21. Because of this difference in orientation, it is now possible for the primary blocks 1 to be self-interlocking along the face edges (48 to 51) of the cube 42. This interesting characteristics of this particular hub may be applicable to other structures, e.g., a cuboctahedron or an octet truss.

As the tapered hub 36*a* now converges to the centre 47 of the cube 42 as shown in FIG. 21, the wedge angle W.A. is now ½ the centre angle. The face edge 48–51 of the cube 42 can be seen to be subtended by the centre angle C.A. (designated theta). The wedge angle W.A. is the angle at X between the centre axis 52 of primary block 1 and the centre axis 48 of the tapered hub 36*a*.

FIG. 20*a* shows a top view of the tapered hub 36*a* and three faces with male dovetail connector means 9 radiating equally around centre axis of the hub. The circle 2 represents an aperture. Although not shown in detail, the sides of aperture 2 and the walls of the tapered hub may be manufactured in thin-walled plastic. Also shown in FIG. 20*a* is edge angle E.A. ( briefly mentioned in FIG. 2*a*) and is shown at a 120 degree angle suitable for the three-way vertices of the two regular polyhedra involved. These angles can vary in more complex polyhedra as displayed around the tapered hub used in the illustration of FIG. 1 and FIG. 2*a*. The configuration of a typical vertex is shown in FIG. 21 where the edge angle E.A. is measured perpendicularly from a point (B) along the axis line from the vertex (V) to the polyhedral centre (47), subtended by the intersecting points (43,44,45) of the adjacent face edges (46–49,46–50,46–51).

(q) Descrntion of FIG. 22*a*, FIG. 22*b*, FIG. 23*a* and FIG. 23*b*

The tapered hubs can produce even more complex polyhedra. Three of the five regular polyhedra use vertices that can be formed by using a three-way tapered hub 36*a*. The octahedron can be constructed with a four-way hub 36*b* as shown in FIGS. 22*a* and 22*b* and the fifth regular solid being the dodecahedron uses a five-way hub 36*c* as shown in FIGS. 23*a*–23*b*. The tapered hubs which are used to construct regular polyhedra will each have congruent wedge angles and edge angles. This is not true for the semi-regular polyhedra as previously mentioned.

As the polygons of the semi-regular polyhedra are not all the same, the vertex may share the edges of two hexagons and a square for example as shown in FIG. 1. Therefore, the hubs which are supplied for these polyhedra will have connection means at various edge angles around the centre axis of the hub, although the wedge angles may be congruent. Out of the thirteen semi-regular polyhedra known as the Archimedean solids, at least six contain vertices that can be constructed with three-way hubs with various edge and wedge angles and the remainder of the polyhedra may use four or five-way hubs. There are more polyhedra that may possibly also be constructed by this method.

Figure 24:
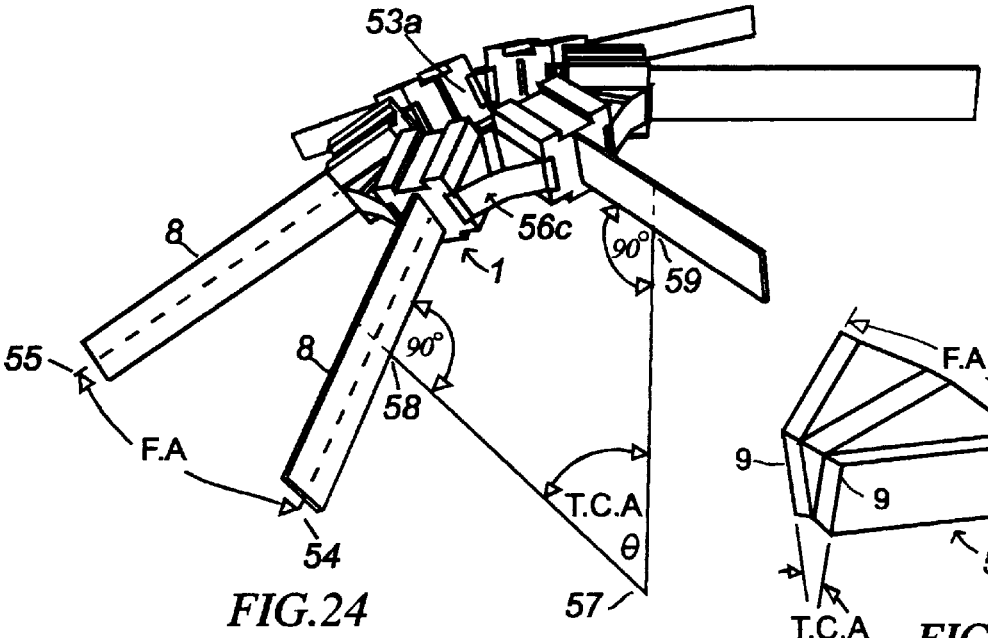
FIG. 24 shows an angle configuration for a vertex assembly as used on a dome structure similar to the one shown in FIG. 26.
Figure 25:
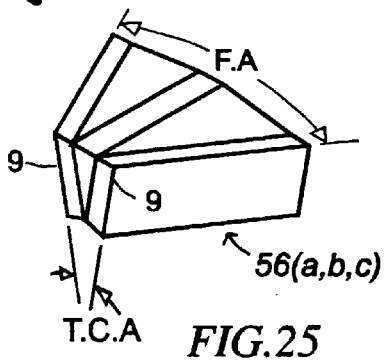
FIG. 25 is a perspective view of an offset-wedge block as used in FIG. 24 and FIG. 26.
Figure 26:
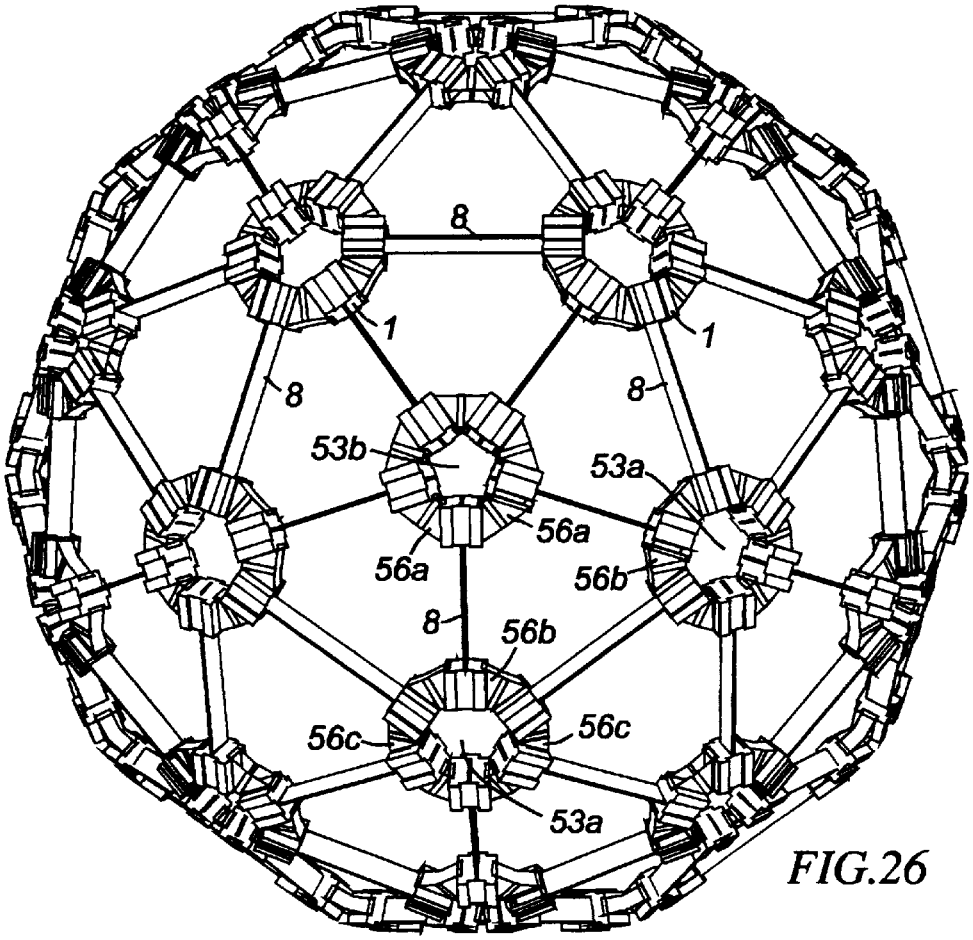
FIG. 26 is an illustrative view of a geodesic dome constructed with craft sticks, primary blocks and various offset-wedge blocks.

(r) Description of FIG. 24, FIG. 25 and FIG. 26

As mentioned earlier, the tapered hub may support the primary blocks at a 90° angle difference in orientation using the tetrahedron as an example. This will then enable the tetrahedron to be constructed with elongated framing pieces connected between the blocks. Although this method is suitable for the tetrahedron, the taper angles of the hub are increased greatly when configured for the more complex polyhedra and it is preferable to use an alternative arrangement, e.g., the offset-wedge block, now referred to in FIG. 24, FIG. 25 and FIG. 26.

When the offset wedge blocks 56*c* as shown in FIG. 24 are interconnected between a circular array of primary blocks 1, they converge in a conic conjunction around a focal vertex 53*a*. This method of forming a vertex with these offset-wedge blocks is useful if the primary block is to be supported with its apertures in line with the face edge of a geodesic dome or polyhedron, thus being able to utilize the elongated framing pieces.

As shown in FIG. 25, the offset-wedge block 56(*a, b, c*) shows two male dovetail faces 9 displaced with respect to independent angles (T.C.A. and F.A.) to each other. FIG. 24. shows T.C.A. (to the centre angle) as the angle which is formed by the projection of two lines from the points 58,59 (which are midpoints of the face edges being at 90° in relation to the craft sticks 8) so constructed as to intersect at the centre point 57 of the sphere or polyhedron under construction. The second angle which is referred to as F.A. (face angle) is the angle between two face edges (54,55) at the vertex point 53*a*.

FIG. 26 is an illustration of a geodesic dome which is constructed with radial configurations of five-way vertex 53*b* and six-way vertex 53*a* assemblies similar to FIG. 24 as mentioned. The dome structure also uses elongated framing pieces 8 and by increasing their length, the dome can be enlarged without changing the angular integrity or shape. The dome is based on the Archimedean semi-regular polyhedron, specifically the icosidodecahedron consisting of 12 pentagons and 20 triangles. Five craft sticks 8 which are supported by primary blocks 1 unite the five vertices 53*a* to form the perimeter of the pentagon. The pentagon is subdivided by five triangles consisting of craft sticks 8 which are supported by two primary blocks 1 which are interconnected by two offset-wedge blocks 56*b* at the base, and further craft sticks which are radially supported by primary blocks 1, which are interspersed by offset-wedge blocks 56*a* at the focal vertex 53*b*. The neighbouring triangles around the pentagons configuring this respective polyhedron, are similarly arranged in like format using a third customised offset-wedge block 56*c*. The combinations of these three wedge blocks are the essentials necessary for the structural configured surface of this geodesic dome.

Figure 27:
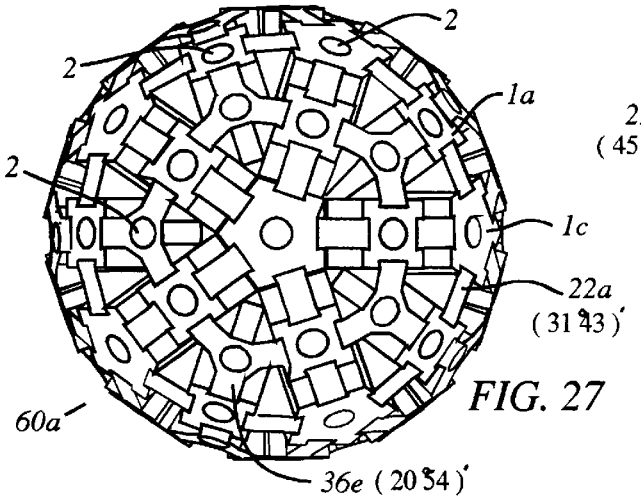
FIG. 27 is an illustrative view of dual polyhedra containing five-way vertex blocks.

(s) Description of FIG. 27

FIG. 27 is an illustration of a dual polyhedra 60*a* using the configuration of the dodecahedron which uses a three-way tapered hub 36*e* having a 120° edge angle and a wedge angle of 20°54', which is interconnected with four-way blocks 1*a* also shown in FIG. 14*c*. This block acts as the fundamental building piece for forming the thirty edges of the dodecahedra and thirty edges of the icosahedron by interconnecting with the five-way vertex configuration (1*c*, 22*a*). This five-way vertex is made up of a five-way block similar to the four-way block la and this is made into a five-way tapered hub by interconnecting five wedge blocks 22*b*, each block of which has a 31°43' angle. This could be replaced by a one-piece hub assembly 36*c* as shown in FIG. 23*a* if so desired. By connecting more primary blocks 1 to the four-way blocks 1*a* the complete configuration can be scaled up without compromising the established shape and angular integrity. The tapered hub assemblies (36*e*,22*a*, 1*c*) and the four-way blocks 1*a* are all provided with apertures 2. This total of sixty-two apertures can support round framing pieces 28 as shown in FIG. 16. These framing pieces will radiate outwards in the vector configuration of the dual polyhedra and can be used to support tapered hubs to form even larger dual polyhedra or a single dodecahedra with 20 vertices or icosahedra with 12 vertices. Geometry books will show that the intersection of edges (which are the apertures of the four-way blocks 1*a*) will also be aligned to the 30 vertices of the quasi-regular icosidodecahedron.

Figure 28:
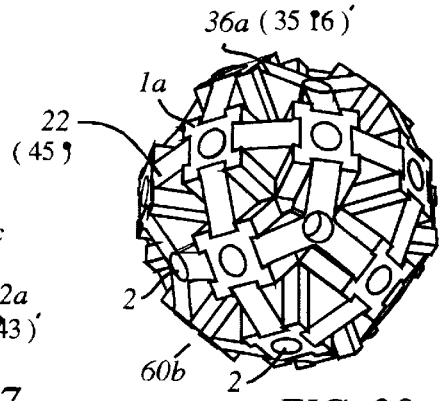
FIG. 28 is an illustrative view of dual polyhedra containing four-way vertex blocks.

(t) Description of FIG. 28

FIG. 28 is another illustration of an alternate spherical combination 60*b*. This one shows the cube and octahedron in a duelling configuration. This assembly now uses four-way blocks 1*a* with four 45-degree wedge blocks 22 to form a tapered hub assembly; it takes six of these assemblies to form the octahedra. The duelling cube however uses eight three-way hubs 36*a* which needs a wedge angle of 35° 16' to interconnect with the octahedra . The edges of this dual polyhedra again use a four-way configuration 1*a* as described in the FIG. 27 for the five-way dual polyhedra. The tapered hubs 36*a* and four-way blocks la all contain the apertures 2. In this configuration, there are twenty-six aperture supports for framing pieces with vector configurations of the cube, octahedra, and the quasi-regular cuboctahedron with its 12 vector equilibrium.

Figure 29:
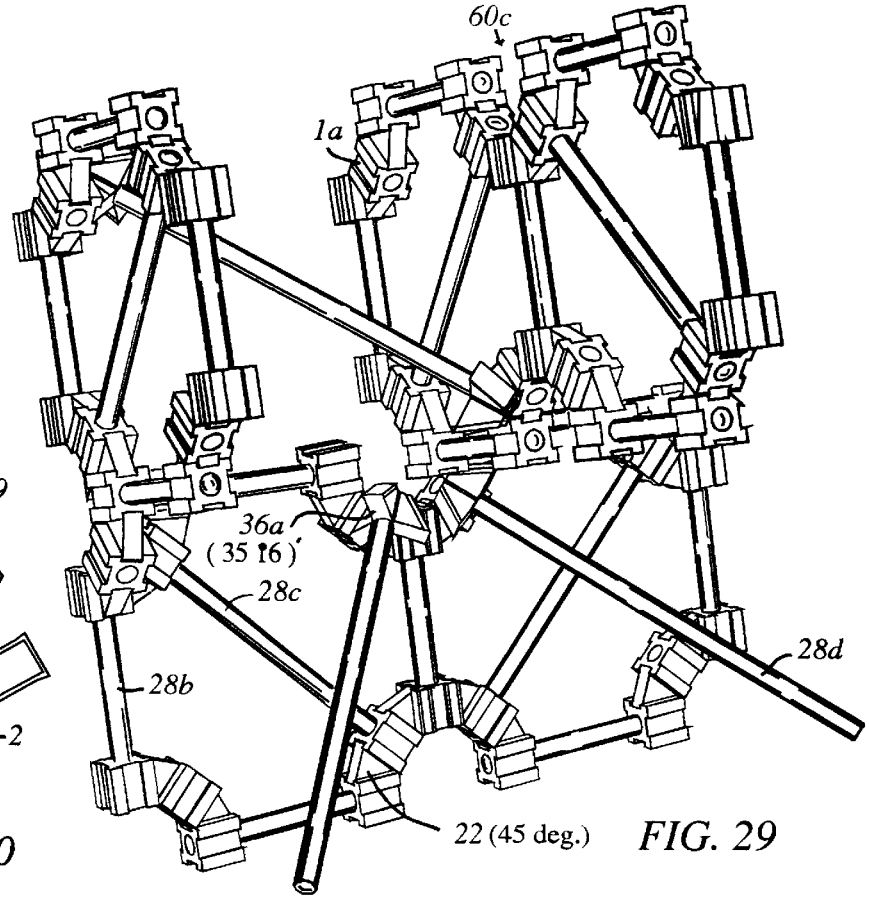
FIG. 29 is an illustrative view of a cubical assembly.

This combination is more versatile than the previous icosahedron dual configuration. Geometry books reveal the three-imension tessellation properties that belong to the tetrahedron and octahedron. This versatility can be proven by the endless configurations that can be assembled using individual pieces that make up the cube and the octahedra dual combination. A good example is shown as follows:

(u) Description of FIG. 29

FIG. 29 is an illustration showing a portion of an assembly of eight cubes to be built into a larger cubical formation. It can be seen that these vertex interconnections of the cubes are made up of blocks 1*a* and 45-degree wedge blocks 22 which can form the spherical structure similar to FIG. 28. The framing pieces 28*b* make up the side edges of the cube. It can be seen that using the framing pieces 28*c*, the hypotenuse of the cube can be formed. This breaks down this configuration into individual tetrahedrons. It can be also seen that by using the tapered hubs 36*a*, a structure as shown in FIG. 28 can be formed. Further to this, by interconnecting the tapered hubs with framing pieces 28*d* the diagonals of the cube can be achieved and this breaks down the configuration into individual octahedrons. It is therefore obvious that the three-dimensional tessellation can be formed not only with cubes but with tetrahedra and octahedra combinations using these building pieces.

Figure 30:
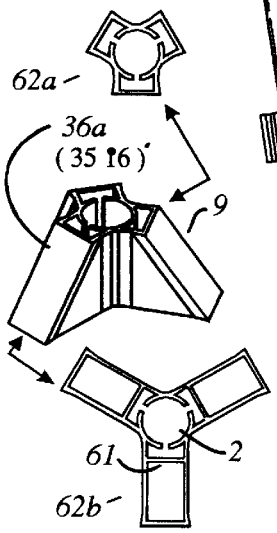
FIG. 30 is an illustrative view of a tapered hub made of plastic.

(v) Description of FIG. 30

FIG. 30 is an illustration of the tapered hub 36*a* which can be manufactured in thin-walled plastic. The tapered hub block 36*c* includes three sloping dovetail tongues 9. The aperture 2 of this tapered hub block 36*c* is made similar to that of the four-sided block but the aperture 2 is split three-ways. This allows for a flexible fit for framing pieces. A bridge 61 is also provided to brace the centre area for firmness. Also shown are the top profiles 62*a* and bottom profiles 62*b* of the hub block 36*a*. Each of these profiles could also be used as end profiles of parallel faced connecting pieces and extruded to any length.

Although the previous examples show polyhedra and a geodesic dome, this does not restrict other embodiments of the invention to these shapes. With the appropriate angular configurations of the conical assemblies and fraring features, it is possible to form any three dimensional models with a framed mesh similar to computerized surface modelling. A water-soluble adhesive could be used to secure the interconnections uniting the models and then removed again by soaking in water.

Figures 31, 32, 33:
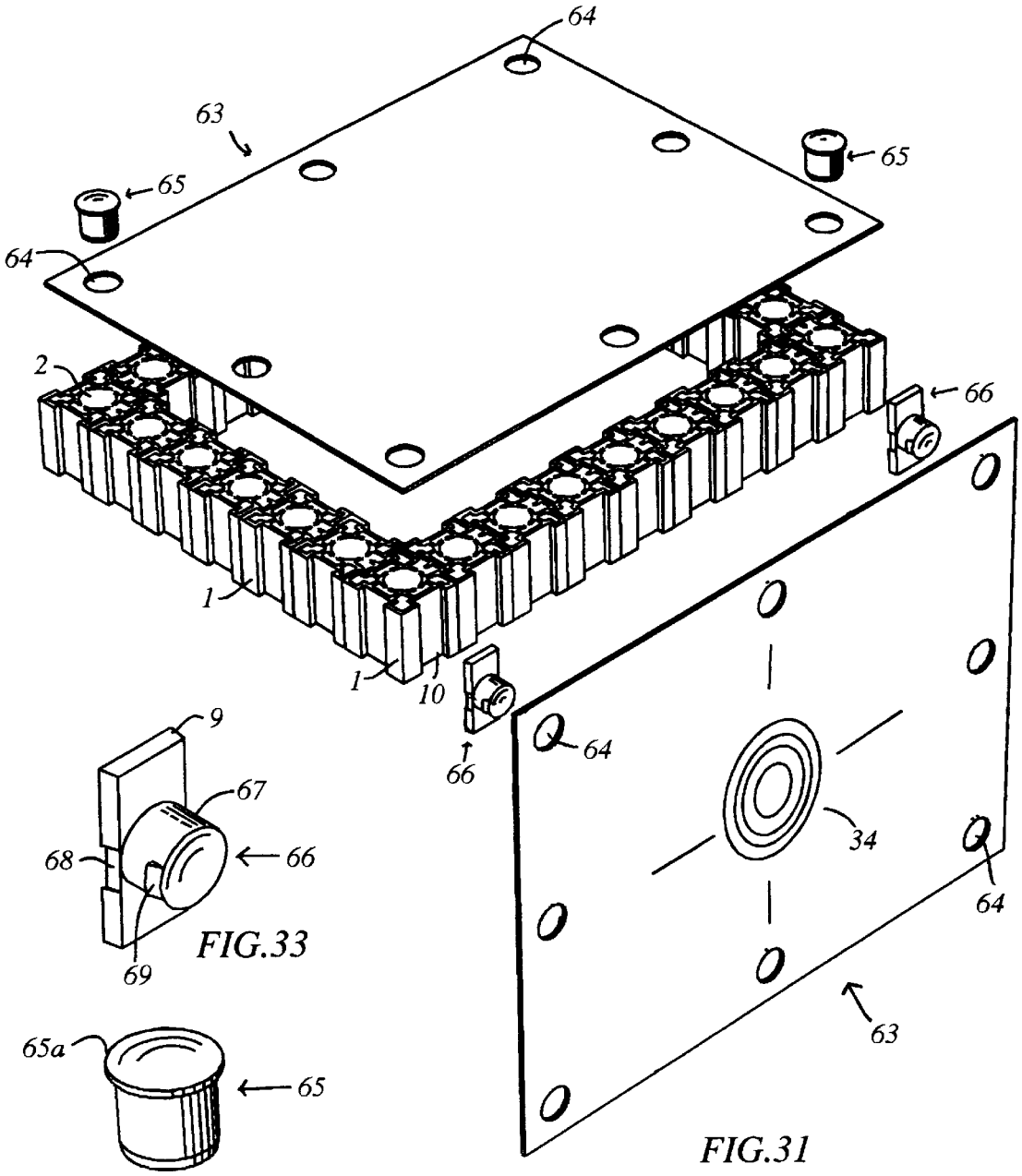
FIG. 31 is an illustrative view of frames of blocks enclosed by panels.
FIG. 32 is a perspective view of a dovetail panel supporting piece.
FIG. 33 is a perspective view of a circular panel supporting piece.

(w) Description of FIG. 31 and FIG. 32

FIG. 31 is the illustration of a framework of primary blocks 1 supplied with panels 63 which can be attached to the interconnected blocks for making walls of toy buildings. The panels 63 can be connected to the blocks 1 using the circular button connector 65 with a shoulder 65*a* provided also shown in FIG. 32. This will pass through the perforation 64 in the panel and can be held in the recess 2 of the primary blocks. The panels 63 can also be supported by the dovetail grooves 10 of the primary blocks 1 by using the support pieces 66. The panels maybe provided with printed matter 34 for further enhancement. The panels can also be triangular or any other suitable shape if preferred.

(x) Description of FIG. 33

FIG. 33 shows a scaled up view of the panel support piece 66. A cut-out 68 is provided in the male dovetail tongue 9 so as to make it easier to mold in plastic the shoulder 69 on one end of the tubular portion 67. This shoulder 69 is used to anchor the panels 63 when engaged in the perforation 64.

Figure 34:
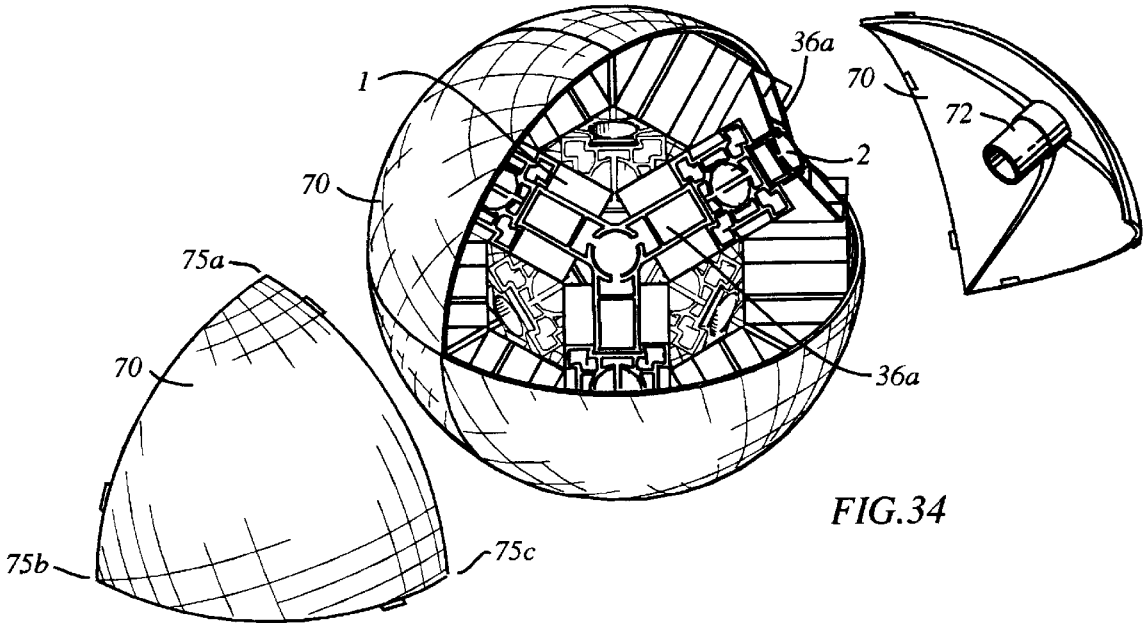
FIG. 34 is an illustrative view of a set of shell pieces added to an assembly of blocks to form a sphere.

(y) Description of FIG. 34

FIG. 34 is an illustration of a sphere partly showing twelve primary blocks 1 and eight tapered hubs 36*a* (which were previously shown in more detail in FIG. 30). This arrangement of blocks is the configuration of a regular cube, the eight tapered hubs 36*a* forming the vertices of the cube. Eight shell pieces 70 are provided. They are triangular in shape, with each vertex (75*a*,75*b* 75*c*) aligned to the central axis of the three adjacent faces about the vertex of the cube that form a dual polyhedron in this case the octahedron. When the edges of the shell pieces 70 run geodesic a sphere can be formed. The surfaces of these shell pieces could also be flat to form the faces of an octahedron or the curved surface could be made up of many flat surfaces similar to a geodesic dome. The hubs 36*a* are provided with axial receptive recesses 2 to receive the axial member 72 which is provided on the shell piece 70 for support means. This axial support member 72 can be of various shapes and is not restricted to the example shown. The shell piece 70 can also be provided with a perforated opening 64 as shown in FIG. 31 and be supported with a circular connector 65.

Figure 35:
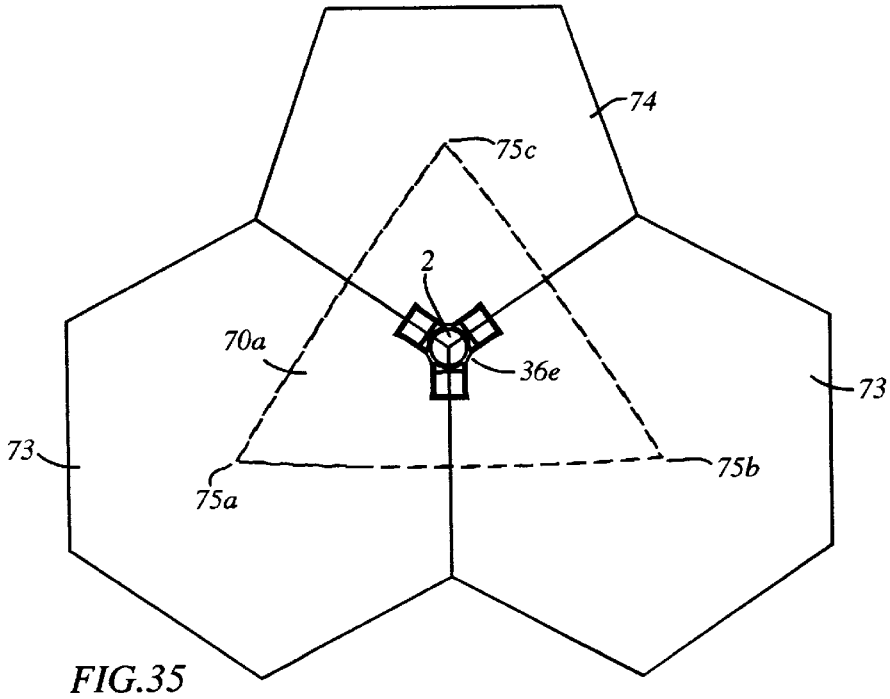
FIG. 35 is an illustration showing part of a polyhedra being changed to its dual using a shell piece.

(z) Description of FIG. 35

FIG. 35 shows another variation of a shell piece 70*a* to that shown in FIG. 34. This shows the three polygons (73,74) about one of the sixty vertices of the truncated icosahedron. The three vertices (75*a*,75*b* & 75*c*) of the shell piece 70*a* are positioned on the central axis of the three faces (74,73) about the vertex of the truncated icosahedron to form the face its dual, that being the pentakis dodecahedron. The hub 36*e* is positioned on the vertex and is provided with a receptive recess 2 to receive an axial member (72 as in to FIG. 34) to support for the shell piece 70*a*.

(6) Conclusion

Many other polyhedra may be turned into spheres as shown in the last two examples if the shell faces conform to that of its dual, although, the number of edges and face shapes may differ on various polyhedra.

From the foregoing description, one skilled in the art can easily ascertain the essential characteristics of this invention, and without departing from the spirit and scope thereof, can make various changes and modifications to the invention to adapt it to various usages and conditions. Consequently, such changes and modifications are properly, equitably, and "intended" to be, within the full range of equivalence of the following claims.

I claim:

1. A toy construction kit for making a sphere comprising a plurality of shell pieces, each of said shell pieces being constructed of thin wall plastic and each having an outer convex surface, said shell pieces having at least three planar side surfaces, each of said planar side surfaces defining axes which intersect at the center point of said sphere, the concave underside of each said shell piece being provided with an upstanding axial connecting member for engagement with an axial receptive recess, whereby each said receptive recess is adapted to provide said shell piece with rigid support at each vertex point of a polyhedral shape which includes both regular and Archimedean semiregular polyhedra, whereby the corners of adjacent sides of said shell pieces are adapted to be aligned to center normal of the polygon faces of said polyhedra so as to enclose the polyhedra and to form a complete spherical surface.

2. The toy construction kit as claimed in claim 1, wherein said each concave underside face of each said shell piece is provided with a rib extending radially-outwardly from said upstanding axial connecting member.

3. The shell piece as claimed in claim 1 or claim 2, wherein said upstanding axial connecting member is generally-cylindrical, and includes an upper collar portion.

4. The shell piece as claimed in claim 1 or 2, wherein said planar side surfaces include means for connection to an adjacent and abutting similar planar side surface of an abutting and adjacent shell piece.

5. The shell piece as claimed in claim 4, wherein said planar side surfaces include means for connection to an adjacent and abutting similar planar side surface of an abutting and adjacent shell piece.

6. The shell piece as claimed in claim 1 or claim 2, wherein said upstanding axial connecting member is generally cylindrical, and includes an upper collar.

7. The triangular shell piece as claimed in claim 6, in combination with two hexagons and one pentagon about one of the sixty vertices of a truncated icosahedron, the vertices of said shell piece being positioned on the central axis of the faces of a truncated icosahedron, thereby providing a pentakis dodecahedron.

8. A toy construction kit for making an octahedron or a geodesic dome comprising a plurality of shell pieces, each of said shell pieces being constructed of thin wall plastic and each having a planar surface, said shell pieces having at least three planar side surfaces, each of said planar side surfaces defining axes which intersect at the center point of said octahedron or geodesic dome, the underside of each said shell piece being provided with an upstanding axial connecting member for engagement with an axial receptive recess, whereby each said receptive recess is adapted to provide said shell piece with rigid support at each vertex point of a polyhedral shape which includes both regular and Archimedean semiregular polyhedra, whereby the corners of adjacent sides of said shell pieces are adapted to be aligned to center normal of the polygon faces of said polyhedra so as to enclose said polyhedra and to form a complete octahedron or geodesic dome surface.

9. The toy construction kit as claimed in claim 8, wherein each underside face of each shell piece is provided with a rib extending radially-outwardly from said upstanding axial connecting member.

10. The shell piece as claimed in claim 8 or 9, wherein said planar side surfaces of each shell piece includes means for connection to an adjacent and abutting similar planar side surface of an abutting and adjacent shell piece.

11. The shell piece as claimed in claim 6, wherein said planar side surfaces of each shell piece includes means for connection to an adjacent and abutting similar planar side surface of an abutting and adjacent shell piece.

12. The triangular shell piece as claimed in claim 8 or 9, in combination with two hexagons and one pentagon about one of the sixty vertices of a truncated icosahedron, the vertices of said shell piece being positioned on the central axis of the faces of a truncated icosahedron, thereby providing a pentakis dodecahedron.

13. The shell piece as claimed in claim 10, in combination with two hexagons and one pentagon about one of the sixty vertices of a truncated icosahedron, the vertices of said shell piece being positioned on the central axis of the faces of a truncated icosahedron, thereby providing a pentakis dodecahedron.

14. A toy construction kit comprising a plurality of modular components each having a central longitudinal axis for building three dimensional structures with a plurality of adjacent components interconnected to each other, said three dimensional structures including regular and Archimedean polyhedrons, the modular components comprising a plurality of different blocks including a sufficient selection of the following different interlockable blocks to enable the building of said three dimensional structures:

(i) a plurality of primary blocks, in which said primary blocks each comprise prismatic blocks, each said prismatic block having four sidewalls, with each sidewall having a fixed length, said sidewalls each defining a dovetail connecting element extending parallel to said central longitudinal axis of said primary block, said ends of said sidewalls and of said dovetail elements defining first and second end faces, with said dovetail connecting elements extending between said first end face and said second end face, said dovetail connecting elements comprising at least one dovetail recess and at least one dovetail tongue, said end faces including interior boundary walls which extend parallel to said central longitudinal axis of said primary block, said interior boundary walls support a central hollow cylindrical member, said central hollow cylindrical member and said interior boundary walls being no longer than said fixed length of said sidewalls;

(ii) a plurality of vertex blocks, in which said vertex blocks each comprise prismatic blocks, each said prismatic block having four sidewalls, with each sidewall having a fixed length, said sidewalls each defining a dovetail connecting element extending parallel to said central longitudinal axis of said vertex block, said ends of said sidewalls and of said dovetail elements defining first and second end faces, with said dovetail connecting elements extending between said first end face and said second end face, said dovetail connecting elements each comprising dovetail recesses, said end faces including interior boundary walls which extend parallel to said central longitudinal axis of said vertex block, said interior boundary walls supporting a central hollow cylindrical member, said central hollow cylindrical member and said interior boundary walls being no longer than said fixed length of said sidewalls;

(iii) a plurality of hub blocks, with each of said hub blocks having a base end surface and a spaced-apart end surface, each said hub block having relatively-thin plastic exterior walls with three planar side surfaces defining three male dovetail tongues, said planar side surfaces being mutually-angularly-disposed about said central longitudinal axis of said hub block by a selected edge angle, said end surfaces including interior boundary walls which extend parallel to said central longitudinal axis of said hub block, said interior boundary walls supporting a central hollow cylindrical member, said central hollow cylindrical member and said interior boundary walls being no longer than said length between said base end surface and said spaced-apart end surface;

(iv) a plurality of wedge blocks, in which each said wedge block has a base end surface and a spaced-apart end surface, said wedge blocks having relatively-thin plastic exterior walls with two planar front and rear surfaces and two planar side surfaces, said two planar side surfaces defining male dovetail tongues, said planar side surfaces being mutually-angularly-disposed about said central longitudinal axis of said wedge block, and converging towards each other at an acute angle with respect to said base end surface, said planar side surfaces also defining axes which intersect at an imaginary apex point, so that said spaced-apart end surface is located between said base end and said imaginary apex point, said wedge block further including a recess which is provided between said base end surface and said spaced apart end surface and which is bounded by said two planar front and rear surfaces and two planar side surfaces;

(v) a plurality of three-way tapered hub blocks, with each said three-way tapered hub block having a base end surface and a spaced-apart end surface, each said three-way tapered hub block having relatively-thin plastic exterior walls with three planar side surfaces defining three male dovetail tongues, said planar side surfaces being mutually-angularly-disposed about said central longitudinal axis of said three-way tapered hub block by a selected edge angle, said planar side surfaces converging at an acute selected wedge angle with respect to said base end surface, said planar side surfaces also defining axes which intersect at an imaginary vertex point, so that said spaced-apart end surface is located between said base end and said imaginary vertex point, said end surfaces including interior boundary walls which extend parallel to said central longitudinal axis of said three-way tapered hub block, said interior boundary walls supporting a central hollow cylindrical member, said central hollow cylindrical member and said interior boundary walls being no longer than said length between said base end surface and said spaced-apart end surface;

(vi) a plurality of four-way tapered hub blocks, with each said four-way tapered hub block having a base end surface and a spaced-apart end surface, each said four-way tapered hub block has relatively-thin plastic exterior walls with four planar side surfaces, said four planar side surfaces defining four male dovetail tongues, said planar side surfaces being mutually-angularly-disposed about said central longitudinal axis of said four-way tapered hub block by a selected edge angle, said planar side surfaces converging at an acute selected wedge angle with respect to said base end surface, said planar side surfaces also defining axes which intersect at an imaginary vertex point, so that said spaced-apart end surface is located between said base end and said imaginary vertex point, said end surfaces including interior boundary walls which extend parallel to said central longitudinal axis of said four-way tapered hub block, said interior boundary walls supporting a central hollow cylindrical member, said central hollow cylindrical member and said interior boundary walls being no longer than said length between said base end surface and said spaced-apart end surface; and (vi) a plurality of five-way tapered hub blocks, with each said five-way tapered hub block having a base end surface and a spaced-apart end surface, each said five-way tapered hub block having relatively-thin plastic exterior walls with five planar side surfaces, said five planar side surfaces defining five male dovetail tongues, said planar side surfaces being mutually-angularly-disposed about said central longitudinal axis of said five-way tapered hub block by a selected edge angle, said planar side surfaces converging at an acute selected wedge angle with respect to said base end surface, said planar side surfaces also defining axes which intersect at an imaginary vertex point, so that said spaced-apart end surface is located between said base end and said imaginary vertex point, said end surfaces including interior boundary walls which extend parallel to said central longitudinal axis of said five-way tapered hub block, said interior boundary walls supporting a central hollow cylindrical member, said central hollow cylindrical member and said interior boundary walls being no longer than said length between said base end surface and said spaced-apart end surface.

15. A toy construction kit as defined in claim 14, wherein said recess of said wedge block is divided by an interior wall extending in a normal direction between said base end surface towards said spaced apart end surface; and/or wherein said recess of said wedge block supports a central hollow cylindrical member.

16. A toy construction kit as defined in claim 14, wherein said central hollow cylindrical member includes at least two radially-extending longitudinal slots, each said slot having a radial inner web portion which is spaced about said central longitudinal axis, wherein said recess serves as an axially receptive recess for connecting with an axial connecting member.

17. A toy construction kit as defined in claim 14, wherein at least some of said female dovetail grooves have chamfered end faces; and/or wherein at least some of said male dovetail tongues are provided with chamfers adjacent to each side face.

18. A toy construction kit as defined in claim 14, wherein each said end faces includes a recessed abutment area which is radially-inward from said lateral sides.

19. A toy construction kit as defined in claim 14, wherein said planar side surfaces of said wedge block define two male dovetail tongues, said two side surfaces being disposed at a 180° wedge angle about said central longitudinal axis and converging towards said imaginary apex; and/or wherein said planar side surfaces of said wedge block define two male dovetail elements, said two side surfaces being disposed at a wedge angle which is less than 180° about said central longitudinal axis, and wherein said two side surfaces converge towards said imaginary apex, thus defining an offset wedge block.

20. A toy construction kit as defined in claim 14, wherein said primary blocks and/or said vertex blocks have a geometry in accordance with said formula:

$$A+B=C$$

and $$A+B+C=D$$

wherein

A is a distance from one edge of a dovetail tongue or a dovetail groove at a mid-height or a mid-depth to an adjacent edge of a nominal square;

B is a distance from an opposite edge of said dovetail tongue or said dovetail groove at a mid-height or a mid-depth to an adjacent edge of a nominal square;

C is a width of said dovetail tongue or said dovetail groove at a mid-height or a mid-depth; and D is a nominal square of side D which is defined by nominal lines drawn parallel to said side faces through mid-height or mid-depth points.

21. A toy construction kit as defined in claim 14, wherein said kit further includes adapter pieces having two generally-parallel faces, said generally-parallel faces of said adapter pieces having interconnecting means, comprising either a pin which is parallel to a face of said piece, or a sleeve which is parallel to a face of said piece, or a male dovetail tongue on a face of said piece, or a female dovetail groove on a face of said piece, or a tongue having a rectangular cross section projecting from a face of said piece, or a tongue having an I-shaped cross section from a face of a said piece, or a tongue having a circular cross section projecting from a face of said piece; and/or wherein said adapter pieces include pieces have one dovetail tongue and one dovetail groove; and/or wherein said adapter pieces include pieces comprising two faces, each face having a male dovetail tongue running therealong and wherein said two faces are disposed about their common axis and converge towards an imaginary apex point; and/or wherein said adapter pieces comprise a plurality of elongated connectors, said elongated connectors being sized and shaped to engage with axially-receptive elements on other said modular components; and/or wherein said adapter pieces comprise a plurality of elongated connectors, said elongated connectors being sized and shaped to engage with axially-receptive elements on other said modular components and being at least four times longer than an exterior length of said modular components; and/or wherein said adapter pieces comprise a plurality of cylindrical connectors, said cylindrical connectors being sized and shaped to engage with axially-receptive elements on other said modular components; and/or wherein said adapter pieces comprise a plurality of cylindrical connectors, said cylindrical connectors being sized and shaped to engage with axially-receptive elements on other said modular components, said cylindrical connectors being at least four times longer than an exterior length of said modular components; and/or wherein said adapter pieces are sized and shaped to engage with axially-receptive elements on other said interlockable blocks triangular pieces to form a six sided hub piece; and/or wherein each said adapter pieces have a male dovetail tongue to support thin-walled panels, said thin-walled panels possibly including curved surfaces.

22. A toy construction kit as defined in claim 14, and further comprising at least two adapter pieces for hinged connection between any of said modular components, one of said adapter pieces having a pin projecting therefrom, and another of said adapter pieces having a sleeve for engagement with said pin.

23. A toy construction kit as defined in claim 14, and further including building pieces, each of said building pieces having a face with an axially-receptive recess; and/or further including building pieces, each of said building pieces having a face with an axially-receptive recess, with a portion of said face being recessed.

24. A toy construction kit as defined in claim 14, further including axial connecting members which comprise rectangularly-shaped panels having edges which are adapted to be inserted into receptive recesses which are provided in, or by, a plurality of interconnected blocks; and/or further including axial connecting members which comprise thin-walled panels, said thin-walled panels being either planar or including curved surfaces; and/or further including axial connecting members which comprise thin-walled panels having perforated openings therethrough, said thin-walled panels being either planar or including curved surfaces; and/or further including axial connecting members which comprise thin-walled panels having perforated openings therethrough, said thin-walled panels being either planar or including curved surfaces, in combination with a plurality of connecting members which are provided with a cylindrical projection for engagement through said perforated openings and into said central hollow cylindrical members of said modular elements.

25. A toy construction kit as defined in claim 24, wherein said panels include indicia in said form of printed matter.

26. A toy construction kit according to claim 14 including a hub structure which is defined by a plurality of offset wedges and prismatic blocks with dovetail grooves which are disposed in an interlocking relationship.

27. A toy construction kit as defined in claim 14, wherein a minimum of twelve modular blocks are interconnected with a minimum of eighteen hub assemblies, said toy construction kit comprising:

six more modular blocks, each said modular block having four lateral sides in a square configuration with female dovetail grooves which are connected to four wedge blocks with male dovetail tongues converging at a 45° angle and which are positioned at right angles about a common axis towards said centre point of a dual polyhedra; and twelve of said tapered hub assemblies, said tapered hub assembly being provided with three male dovetail tongues converging at an angle of 35°16' equally positioned about a common axis toward said centre point of said dual polyhedra;

said blocks being interconnected in a spherical shape so as to define a complete dual polyhedra in said configuration of a cube and a regular octahedron.

28. A toy construction kit as recited in claim 27, wherein axially-receptive recesses are provided in said modular blocks and in said tapered hubs for accommodating axial connecting members having two ends, and wherein said axial connecting members define at least twenty-six vectors from a centre of said polyhedra, said interconnecting means thus being provided for interconnecting full and partial assemblies of said polyhedra with similar assemblies in three dimensional tessellation, by using said axial members with lengths determined by traditional geometrical constants.

29. The toy construction kit as claimed in claim 14, wherein at least said prismatic block and said six-sided block includes a circular wall of a hollow cylinder including four diametrically-opposed slots, each slot leading to an associated hollow recess.

30. The toy construction kit as claimed in claim 29, wherein said prismatic block includes three dovetail groves and one projecting dovetail rib on four sidewalls.

31. The toy construction kit as claimed in claim 29, wherein said six-sided block includes three dovetail groves and one projecting dovetail rib on four sidewalls.

32. The toy construction kit as claimed in claim 29, wherein said prismatic block includes four dovetail groves on four sidewalls.

33. The toy construction kit as claimed in claim 29, wherein said six-sided block includes four dovetail groves on four sidewalls.

34. The toy construction kit as claimed in claim 29, wherein said wedge block includes three arms which extend equiangularly around said circular wall of said hollow cylinder, and which project at an angle of 90° from said circular wall of said hollow cylinder, and further wherein exposed faces of said arms are parallel to the longitudinal axis of said circular wall of said hollow cylinder.

35. The toy construction kit as claimed in claim 29, wherein said wedge block includes three arms which extend equiangularly around said circular wall of said hollow cylinder, and which project at an angle of 90° from said circular wall of said hollow cylinder, and wherein exposed faces of said arms slope downwardly at an angle of 60°.

36. The toy construction kit as claimed in claim 29, further including adapter pieces, said adapter pieces including a first cylindrical portion having an external diameter of a size to be frictionally-engaged within said circular wall of said hollow cylinder.

37. The toy construction kit as claimed in claim 36, wherein said first cylindrical portion terminates in a plate which projects at right angles from said cylindrical portion.

38. The toy construction kit as claimed in claim 36, including a second cylindrical portion having an external diameter of a size to be frictionally-engaged within said circular wall of said hollow cylinder, said second cylindrical portion being separated from said first cylindrical portion by an upstanding encircling disc.

39. The toy construction kit as claimed in claim 38, including a longitudinally-extending rib, extending in both longitudinal directions from said upstanding encircling disc.

40. A toy construction kit comprising a plurality of modular components each having a central longitudinal axis for building three dimensional structures with a plurality of adjacent components interconnected to each other, said three dimensional structures including regular and Archimedean polyhedrons, said modular components comprising:

a prismatic block having a plurality of sidewalls with each side having a fixed length, said sides defining a plurality of dovetail connecting elements extending parallel to said central longitudinal axis, said sides and dovetail elements defining first and second end faces, with a perimeter of at least said first end face defining a minimum of three recesses running towards said second end face, said recesses being separated by interior boundary walls which extend parallel to said central longitudinal axis, said interior boundary walls being at least part of the fixed length of said sidewalls;

a second set of elements selected from at least one of the group consisting of:

(i) a wedge block having a base end surface and a spaced apart end surface, said block having relatively thin plastic exterior walls with two planar side surfaces defining male dovetail connection elements, said planar side surfaces being mutually angularly disposed about said central longitudinal axis and said planar side surfaces converging at an acute angle with respect to said base end surface, said planar side surfaces defining axes which intersect at an apex point, said spaced apart end surface being located between said base end and said apex point, said wedge block further including a recess provided between said base end surface and said spaced apart end surface;

(ii) a tapered hub block having a base end surface and a spaced apart end surface, said block having relatively thin plastic exterior walls with at least three planar side surfaces defining male dovetail connection elements, said planar side surfaces being mutually angularly disposed about said central longitudinal axis and said planar side surfaces converging at an acute angle with respect to said base end surface, said planar side surfaces defining axes which intersect at a vertex point, said spaced apart end surface being located between said base end and said vertex point, said tapered hub further including a recess provided between said base end surface and said spaced apart end surface;

(iii) a six sided block composed of four lateral sides, first and second end surfaces, each side lateral side defining dovetail connecting elements running parallel to said central longitudinal axis and extending to each of said first and second end surfaces, said end surfaces of said block defining at least three recesses running from one of said first and second end surfaces towards the other of said end surfaces, said recesses being separated by interior boundary walls and extended parallel to said central longitudinal axis, one of the said recesses being cylindrical, the walls of the said cylindrical recess further including at least two radially extending longitudinal slots, said recess being configured for mating with an axial connecting member.

41. A toy construction kit as defined in claim 40, wherein said recess of said wedge block is divided by an interior wall extending normally between said base end surface towards the said spaced apart end surface.

42. A toy construction kit as defined in claim 40, wherein one of the said recesses of said prismatic block define a generally cylindrical shape with at least two radially extending longitudinal slots, each with a radial inner web portion spaced about said central longitudinal axis, wherein said recess serves as an axially receptive recess for connecting with an axial connecting member.

43. A toy construction kit as defined in claim 40, wherein said dovetail connecting elements of the said prismatic block comprise female dovetail grooves and wherein said grooves have chamfered end faces.

44. A toy construction kit as defined in claim 40, wherein each of the said end faces includes a recessed abutment area radially inward from said lateral sides.

45. A toy construction kit as defined in claim 40, wherein said planar side surfaces of said wedge block generally define male dovetail elements, said two side surfaces being disposed at 180-degree angle about the said central longitudinal axis and converging towards said apex.

46. A toy construction kit as defined in claim 40, wherein said planar side surfaces of said wedge block generally define male dovetail elements, said two side surfaces converging towards said apex, said two side surfaces being disposed at an angle less than 180-degrees about the said central longitudinal axis, thus defining an offset wedge block.

47. A toy construction kit according to claim 40 or 46, wherein a hub structure is defined by a plurality of offset wedges and prismatic blocks with dovetail connecting faces disposed in an interlocking relationship.

48. A toy construction kit as defined in claim 40, wherein said six-sided block has a dovetail tongue or dovetail groove, and wherein said block has a geometry in accordance with the formula:

$$A+B=C$$

and $$A+B+C=D$$

wherein

A is a distance from one edge of a dovetail tongue or dovetail groove at a mid-height or a mid-depth to an adjacent edge of a nominal square;

B is a distance from an opposite edge of said dovetail tongue or dovetail groove at a mid-height or a mid-depth to an adjacent edge of a nominal square;

C is a width of said dovetail tongue or dovetail groove at a mid-height or a mid-depth;

D is a nominal square of side D defined by nominal lines drawn parallel to said side faces through mid-height or mid-depth points.

49. A toy construction kit is defined in claim 40, wherein said recess of said tapered hub is divided by at least one interior wall extending normally to said base end surface towards the said spaced apart end surface.

50. A toy construction kit as defined in claim 40, wherein said recess of said tapered hub block is configured as an axially receptive recess for mating with an axial connecting member having two ends.

51. A toy construction kit as defined in claim 40, wherein a minimum of twelve prismatic blocks are interconnected with a minimum of eighteen hub assemblies comprising:

six more prismatic blocks each having four lateral sides in a square configuration with female dovetail elements connected to four wedge blocks with male dovetail elements converging at a 45-degree angle and positioned at right angles about a common axis towards the center point of the said dual polyhedra;

twelve of said tapered hub assemblies each being provided with three male dovetail elements converging at an angle of 35-degree and 16-minutes equally positioned about a common axis toward the center point of the said dual polyhedra;

said blocks being interconnected in a spherical shape so as to define a complete dual polyhedra in the configuration of a cube and a regular octahedron.

52. A toy construction kit as recited in claim 51, wherein said axially receptive recesses are provided on the prismatic blocks and tapered hubs for accommodating axial connecting members having two ends, and wherein said axial connecting members define at least twenty-six vectors from a center of said polyhedra, the interconnecting means thus being provided for interconnecting full and partial assemblies of the said polyhedra with similar assemblies in three dimensional tessellation, by using said axial members with lengths determined by traditional geometrical constants.

53. A toy construction kit as recited in claim 40, where said dovetail elements of the said prismatic blocks are male dovetail elements and female dovetail elements.

54. A toy construction kit as recited in claim 40, wherein said kit further includes adapter pieces having two generally parallel faces, said faces of said adapter pieces having interconnecting means selected from the group consisting of:

a pin parallel to a face of said piece;

a sleeve parallel to a face of said piece;

a male dovetail on a face of said piece;

a female dovetail on a face of said piece;

a tongue having a rectangular cross section projecting from a face of said piece;

a tongue having an I-shaped cross section from a face of a said piece;

a tongue having a circular cross section projecting from a face of said piece.

55. A toy construction kit as defined in claim 54, wherein the said adapter pieces includes pieces having two dovetail surfaces.

56. A toy construction kit as defined in claim 54, wherein the said adapter pieces include pieces comprising a dovetail and tongue on a face of said piece.

57. A toy construction kit as defined in claim 54, wherein the said adapter pieces include pieces comprising two faces, each face having a male dovetail element running therealong and wherein said faces are disposed about their common axis and converge towards an apex point.

58. A toy construction kit as defined in claim 54, further comprising at least two adapter pieces for hinged connection between any of said modular components, one of said adapter pieces having a pin projecting therefrom, and another of the said adapter pieces having a sleeve for engagement with said pin.

59. A toy construction kit as defined in claim 40, and further including elongated connectors, and wherein said connectors are at least four times longer than an exterior length of said modular components.

60. A toy construction kit as defined in claim 40, and further including building pieces, wherein each of said pieces has a face with an axially receptive recess, and wherein a portion of said face is recessed.

61. A toy construction kit as defined in claim 40, wherein said kit further includes connector members having an I-shaped cross section, defined by a main web and two end arms, and a cross web spanning between said arms.

62. A toy construction kit as defined in claim 40, wherein said kit includes adapter pieces having at least three surface faces, each said face including a dovetail element.

63. A toy construction kit as defined in claim 62, wherein said adapter pieces are sized and shaped to engage with corresponding dovetail elements on other triangular pieces to form a six sided hub piece.

64. A toy construction kit as defined in claim 40, wherein said dovetail connecting faces of said modular components comprise dovetail elements, wherein at least some of said dovetail elements are provided with chamfers adjacent to each side face.

65. A toy construction kit as defined in claim 42, wherein said axial connecting members comprise rectangularly shaped panels having edges adapted to be inserted into receptive recesses provided by a plurality of interconnected blocks.

66. A toy construction kit as defined in claim 42, wherein said axial connecting members support thin wall panels, said panels including curved surfaces.

67. A toy construction kit as defined in claim 42, wherein said axial connecting members are provided with shoulders to support thin wall panels with perforated openings, said panels including curved surfaces.

68. A toy construction kit as defined in claim 54, wherein said adapter piece having a male dovetail face and a tongue to support thin wall panels, said panels including curved surfaces.

69. A toy construction kit as defined in any of claim 65, claim 66, claim 67, and claim 68 wherein said panels include indicia in the form of printed matter.

* * * * *

UNITED STATES PATENT AND TRADEMARK OFFICE

CERTIFICATE OF CORRECTION

PATENT NO. : 6,059,631
DATED : May 9, 2000
INVENTOR(S) : Paul T. Maddock

It is certified that error appears in the above-identified patent and that said Letters Patent is hereby corrected as shown below:

Please insert category "[30] Foreign Application Priority Data" as follows:

-- [30] Foreign Application Priority Data
March 8, 1996 [CA] ..... 2,171,355 --

Signed and Sealed this

Thirty-first Day of July, 2001

*Attest:*

Nicholas P. Godici

*Attesting Officer*

NICHOLAS P. GODICI
*Acting Director of the United States Patent and Trademark Office*